US007575433B2

(12) United States Patent
Shibata et al.

(10) Patent No.: US 7,575,433 B2
(45) Date of Patent: Aug. 18, 2009

(54) SPORTS SKILL EVALUATION SYSTEM

(75) Inventors: Yoshinori Shibata, Sapporo (JP); Tatsuya Dobashi, Ninohe (JP)

(73) Assignee: Spotrend Co., Ltd. (JP)

( * ) Notice: Subject to any disclaimer, the term of this patent is extended or adjusted under 35 U.S.C. 154(b) by 538 days.

(21) Appl. No.: 11/322,592

(22) Filed: Jan. 3, 2006

(65) Prior Publication Data

US 2007/0166680 A1 Jul. 19, 2007

(51) Int. Cl.
*A63B 69/00* (2006.01)

(52) U.S. Cl. ..... 434/247

(58) Field of Classification Search ..... 434/247, 434/252; 482/8–9, 902
See application file for complete search history.

(56) References Cited

U.S. PATENT DOCUMENTS 5,888,172 A * 3/1999 Andrus et al. ..... 482/7
6,126,449 A * 10/2000 Burns ..... 434/252
6,648,798 B2 * 11/2003 Yoo ..... 482/8
2004/0241629 A1 * 12/2004 Ondrusz et al. ..... 434/247
2004/0248071 A1 * 12/2004 Bedziouk et al. ..... 434/247

FOREIGN PATENT DOCUMENTS

JP 2003-029615 1/2003

* cited by examiner

*Primary Examiner*—Cameron Saadat
(74) *Attorney, Agent, or Firm*—Rader Fishman & Grauer PLLC

(57) ABSTRACT

A sports skill evaluation system is provided which can perform a detailed skill analysis based on the level, match experience, age, sex and so forth of a user, careful advice based on a result of the skill analysis, rearing diagnosis in the future, estimation evaluation with the growth in the future taken into consideration and so forth. Individual application coefficients stored in a coefficient table in advance are referred to based on basic user data of the user including the level, match experience, age and sex and a score according to a result of a match to calculate skill item points for individual skills required for the match, and diagnosis graphs for the individual skills are produced from the calculated skill item points for the individual skills. The level, match experience, age and sex of the user are converted into numerical values, and a comment pattern designation value is calculated for each skill item in accordance with a predetermined calculation expression from the numerical values. A comment of a number corresponding to the comment pattern designation value is extracted for each skill item from a comment table.

10 Claims, 22 Drawing Sheets

EXAMPLE OF SELECTION OF COMMENT PATTERN CIRCUIT

FIG. 12

INPUT PERSONAL BASIC DATA ON INPUTTING/OUTPUTTING APPARATUS,
AGE: 12 YEARS OLD,
SEX: MALE,
MATCH EXPERIENCE: 4 YEARS

FOR LEVEL, NORMAL IS SELECTED

SINCE MATCH EXPERIENCE IS EQUAL TO OR MORE THAN 3 YEARS BUT LESS THAN 6 YEARS, LEVEL-BASED CATEGORY IS DETERMINED TO BE CATEGORY 4

SINCE NORMAL IS SELECTED FOR LEVEL AND DATA OF MATCH EXPERIENCE IS 4 YEARS, LEVEL-BASED COEFFICIENT IS TEMPORARILY DETERMINED TO BE 1.23 FROM LEVEL-BASED COEFFICIENT GRAPH

SINCE AGE IS 12, AGE-BASED CATEGORY IS DETERMINED TO BE CATEGORY 6

SINCE NORMAL IS SELECTED FOR LEVEL AND DATA OF AGE IS 12, AGE-BASED COEFFICIENT IS TEMPORARILY DETERMINED TO BE 1.33 FROM AGE-BASED COEFFICIENT GRAPH

SINCE SEX IS MALE, SEX-BASED CATEGORY IS DETERMINED TO BE CATEGORY 1

SINCE SEX IS MALE, SEX-BASED COEFFICIENT IS TEMPORARILY DETERMINED TO BE 1 FROM SEX-BASED COEFFICIENT GRAPH

SINCE LEVEL IS NORMAL, COMMENT PATTERN IS DETERMINED TO BE 335 FROM THREE DETERMINED CATEGORIES

CALCULATE AVERAGE VALUE FROM THREE DETERMINED COEFFICIENTS, DETERMINE COMPOSITE COEFFICIENT TO BE 1.18

SCORING OF RESULT OF MATCH

CALCULATE STILL ITEM POINTS TILL SECONDARY SETTLEMENT BY ARITHMETIC OPERATION SOFTWARE BASED ON SCORE. HERE, IT IS ASSUMED THAT TECHNIQUE POINT OF PERSON A IS 50 POINTS

INCLUDE COMPOSITE APPLICATION COEFFICIENT 1.18 INTO 50 POINTS TO CALCULATE FINAL STILL ITEM POINT 59

PRODUCE FINAL SILL ITEM GRAPH BASED ON FINAL SKILL ITEM POINT

EXTRACT PERTAINING COMMENT FROM SKILL ITEM COMMENT TABLE FOR TECHNIQUE BASED ON COMMENT PATTERN 335 AND FINAL STILL ITEM POINT 59

REQUIRED FACTOR COMPARISON DIAGNOSIS GRAPH

SKILL ITEM-BASED COMPARISON DIAGNOSIS GRAPH

SPORTS SKILL EVALUATION SYSTEM

BACKGROUND OF THE INVENTION

1. Field of the Invention

The present invention relates to a sports skill evaluation system which makes use of a computer.

2. Description of the Related Art

A ranking system which performs ranking with regard to the sports skill and the foreign language conversation communication skill is known and disclosed in Japanese Patent laid-Open No. 2003-29615 (hereinafter referred to as Patent Document 1). The ranking system of Patent Document 1 includes means for inputting a kind, a record or a rank order of sports, means for arithmetically operating a sport point from the record and/or the rank order, means for selecting language study, means for inputting a foreign language conversation communication skill of the language, means for arithmetically operating a language study point from the foreign language conversation communication skill, means for comparing the sports point with data recorded and accumulated in a network server through a network to calculate a ranking, means for displaying the ranking, and means for presenting information for enhancing the language study point (a list of words used in a sports event to be played by a participant, an illustrative sentence, sound information of reading the illustrative sentence aloud and so forth) in response to a result of the language study point.

However, with the ranking system described above, only rough ranking is performed taking both of the sports skill and the foreign language conversation communication skill into consideration. However, the ranking system cannot perform a detailed skill analysis (evaluation) based on the level, match experience, age, sex and so forth of a user, careful advice based on a result of the skill analysis, rearing diagnosis in the future, estimation evaluation with the growth in the future taken into consideration and so forth cannot be performed.

SUMMARY OF THE INVENTION

It is an object of the present invention to provide a sports skill evaluation system which can perform a detailed skill analysis (evaluation) based on the level, match experience, age, sex and so forth of a user, careful advice based on a result of the skill analysis, rearing diagnosis in the future, estimation evaluation with the growth in the future taken into consideration and so forth.

In order to attain the object described above, according the present invention, there is provided a sports skill evaluation system comprising an inputting section for inputting, while course selection items displayed on a screen are selected, required data for each of the items regarding a user, a basic database for storing personal basic data of the user including a level, a match experience, an age and a sex inputted through the inputting section, a coefficient table in which application coefficients including level-based coefficients, age-based coefficients and sex-based coefficients are stored in advance, application coefficient calculation means for referring to the coefficient table based on the level, age and sex inputted through the inputting section to determine respective individual application coefficients, skill item point calculation means for calculating, from a score according to a result of a match of the user inputted through the inputting section and the individual application coefficients determined by the application coefficient calculation section, a skill item point for each of skills required for the match, skill diagnosis graph production means for producing diagnosis graphs for the individual skills from the skill item points for the individual skills calculated by the skill item point calculation means, comment pattern designation value calculation means for converting the level, match experience, age and sex inputted through the inputting section into numerical values and calculating comment pattern designation values for the individual skill items based on the numerical values in accordance with a predetermined calculation expression, a comment table in which a plurality of comments to be presented each as a comment to a user are stored such that the comments are classified for the individual skill items and are numbered for the individual comments, and comment extraction means for extracting a comment of a number corresponding to each of the comment pattern designation values calculated by the comment pattern designation value calculation means for each of the skill items from the comment table.

It is to be noted that the skill items are items used as a reference in evaluation of the skill regarding a match and may include, for example, technique, decision power, judgment, physical, sense, creativity, spirit, potential skill, offensive power, defensive power, body balance, fantajista degree, tactics (strategy understanding) and so forth.

In the sports skill evaluation system, the individual application coefficients stored in the coefficient table in advance are referred to based on the basic user data of the user including the level, match experience, age and sex and the score according to a result of a match to calculate skill item points for individual skills required for the match. Then, diagnosis graphs for the individual skills are produced from the calculated skill item points for the individual skills. Further, from the level, match experience, age and sex of the user converted into numerical values, a comment pattern designation value is calculated for each skill item in accordance with a predetermined calculation expression. A comment of a number corresponding to the comment pattern designation value is extracted for each skill item from the comment table and presented to the user. Therefore, the sports skill evaluation system can perform a detailed skill analysis (evaluation) based on the level, match experience, age, sex and so forth of the user, careful advice such as rearing diagnosis based on a result of the skill analysis and so forth.

Preferably, the sports skill evaluation system further comprises required factor point calculation means for calculating, from the score according to the match result of the user inputted through the inputting section, a point for each of required factors regarding the match, the skill item point calculation means being operable to select, from the points for the individual required factors calculated by the required factor point calculation means, points of required factors relating to the skill items and calculate skill item points from the selected points and the individual application coefficients in accordance with a predetermined calculation expression.

In the sports skill evaluation system, a point for each of required factors regarding the match is calculated from the score according to the inputted match result of the user, and from the points for the calculated individual required factors, points of required factors relating to the skill items are selected. Then, skill item points are calculated from the selected points and the individual application coefficients in accordance with the predetermined calculation expression. Therefore, a detailed skill analysis can be achieved taking fragmented required factors required for the match into consideration.

It is to be noted that the required factors may include, for example, match experience, guidance experience, spirit of inquiry, diligence, foresight, judgment, sense of play, flexibility in thinking, conception, unexpectedness, centripetal force, timing, insight, adaptability, self-sacrifice, egocentricity, leadership, concentration, durability, external pressure, internal pressure, guts, fair spirit, aspiration, ambition, tenaciousness, resilience, communication ability, broadness in range of vision, cleverness, sense of responsibility, search ability, speed, instantaneous reaction, power, agility, jumping force, reflect action, physical pliability, kinetic vision, body balance in the upward, downward, leftward and rightward directions, persistence against an injury and disease, shoot, pass, dribble, trap, meet still, accuracy, balance in handling of a ball, faint, keep power, positioning, success rate and so forth.

The sports skill evaluation system may further comprise required factor-based diagnosis graph production means for producing a diagnosis graph for each of the required factors from the required factor points calculated by the required factor point calculation means.

In the sports skill evaluation system, since a diagnosis graph for each of the required factors is produced from the required factor points, a diagnosis for each of the fragmented required factors required for the match can be performed.

The sports skill evaluation system may further comprise skill item-based comparison diagnosis graph production means for comparing the skill item points calculated by the skill item point calculation means with the other skill item points stored in the basic database to produce a comparison diagnosis graph.

In the sports skill evaluation system, since a comparison diagnosis graph wherein the calculated skill item points and the other skill item points stored in the basic database are compared with each other, comparison with data in the past regarding the same user, comparison with other users and so forth can be indicated.

The comment extraction means may extract a future image prediction comment representative of a predicted future image from the comment table based on a particular age condition inputted through the inputting section.

In the sports skill evaluation system, since a future image prediction comment representative of a predicted future image is extracted from the comment table based on an inputted particular age condition, a future rearing diagnosis, an estimation evaluation with the future growth taken into consideration and so forth can be performed.

The sports skill evaluation system maybe configured such that the basic database stores heart rates of the user, and the skill item point calculation means calculates a spiritual skill item of the user through comparison between the heart rate in a normal state and the heart rate in a particular situation produced intentionally.

In the sports skill evaluation system, since a spiritual skill item of the user can be calculated through comparison between the heart rate in a normal state of the user and the heart rate in a particular situation produced intentionally, also evaluation of a spiritual skill can be performed.

The sports skill evaluation system maybe configured such that the basic database stores a health diagnosis result of the user, and the skill item point calculation means refers to the health diagnosis result and basic data arithmetically operated based on the health diagnosis result to calculate points of skill items relating to the health of the user.

In the sports skill evaluation system, since the health diagnosis result of the user and basic data arithmetically operated based on the health diagnosis result are referred to to calculate points of skill items relating to the health of the user, the points are useful to the health care.

The sports skill evaluation system maybe configured such that the skill item point calculation means performs ranking of the user based on the calculated skill item points.

In the sports skill evaluation system, since ranking of the user is performed based on the calculated skill item points, the user can be ranked in accordance with the skills of the user, and therefore, also grouping based on the ranking can be performed readily. Further, since also it is possible to provide a skill item point based on the rank, also comparison and evaluation of the skill item point can be performed among participants of the match.

The inputting section may input basic user data of the user including the level, match experience, age and sex, contest results and so forth from a storage medium.

In the sports skill evaluation system, since basic user data of the user including the level, match experience, age and sex, contest results and so forth are inputted from a storage medium such as an IC tag or a contactless IC card, the inputting is accurate and easy and the secrecy of personal information can be maintained.

Alternatively, the sports skill evaluation system may be configured such that the inputting section acquires basic user data of the user including the level, match experience, age and sex through a web site of the Internet, and the comment extraction section presents the extracted comment on the web site.

In the sports skill evaluation system, since basic user data of the user including the level, match experience, age and sex are acquired through a web site of the Internet and the comment extracted from the comment table is presented on the web site, a sports skill evaluation system which makes use of the Internet can be provided.

The above and other objects, features and advantages of the present invention will become apparent from the following description and the appended claims, taken in conjunction with the accompanying drawings in which like parts or elements are denoted by like reference symbols.

BRIEF DESCRIPTION OF THE DRAWINGS

FIG. 12 is a flow chart illustrating a series of processes until a comment is extracted with regard to a technique which is one of skill items in order from above;

DESCRIPTION OF THE PREFERRED EMBODIMENT

Figure 1:
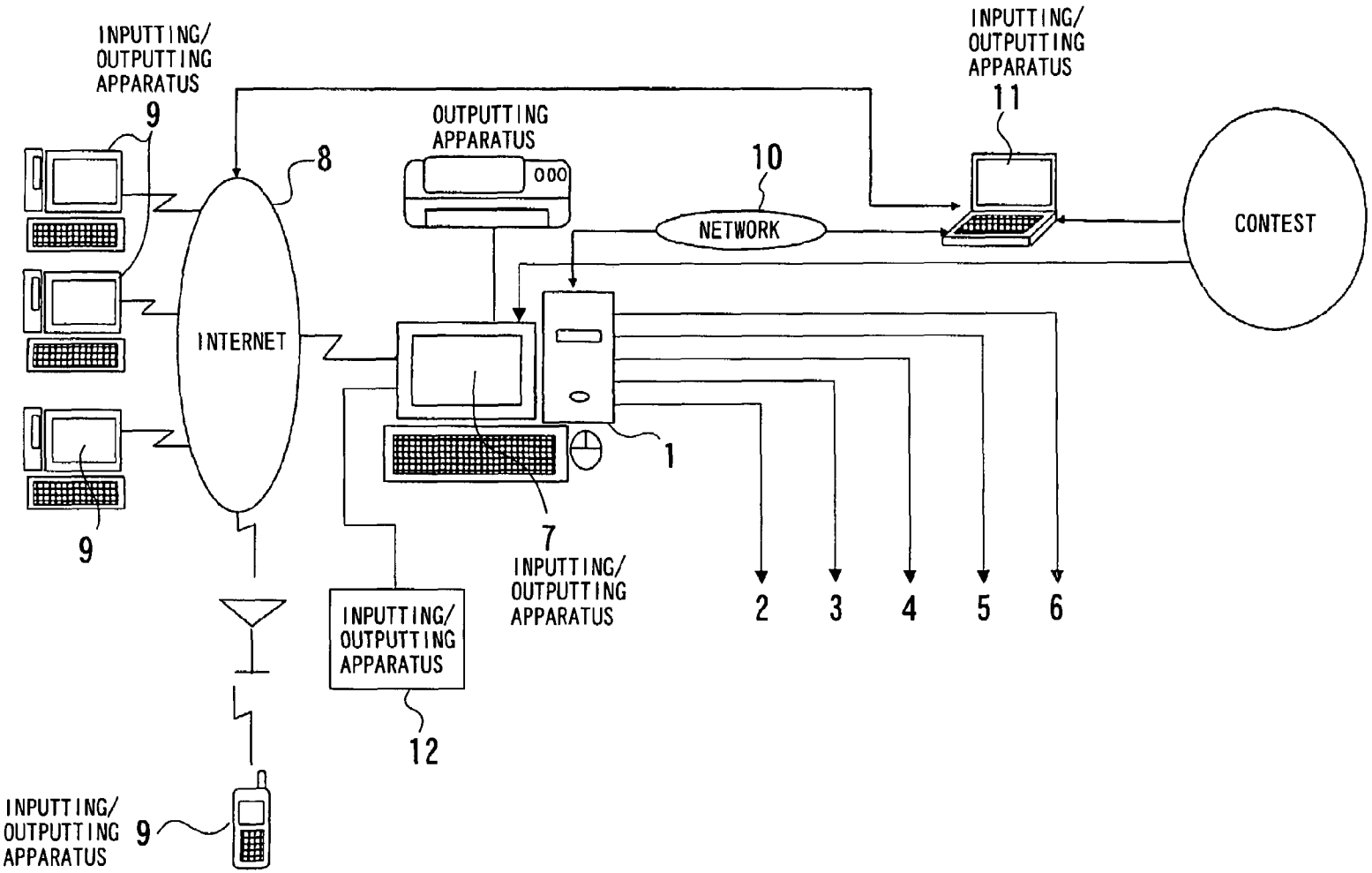
FIG. 1(A) to FIG. 1(F) are block diagrams showing an example of a general configuration of a sports skill evaluation system to which the present invention is applied.
Figure 1:
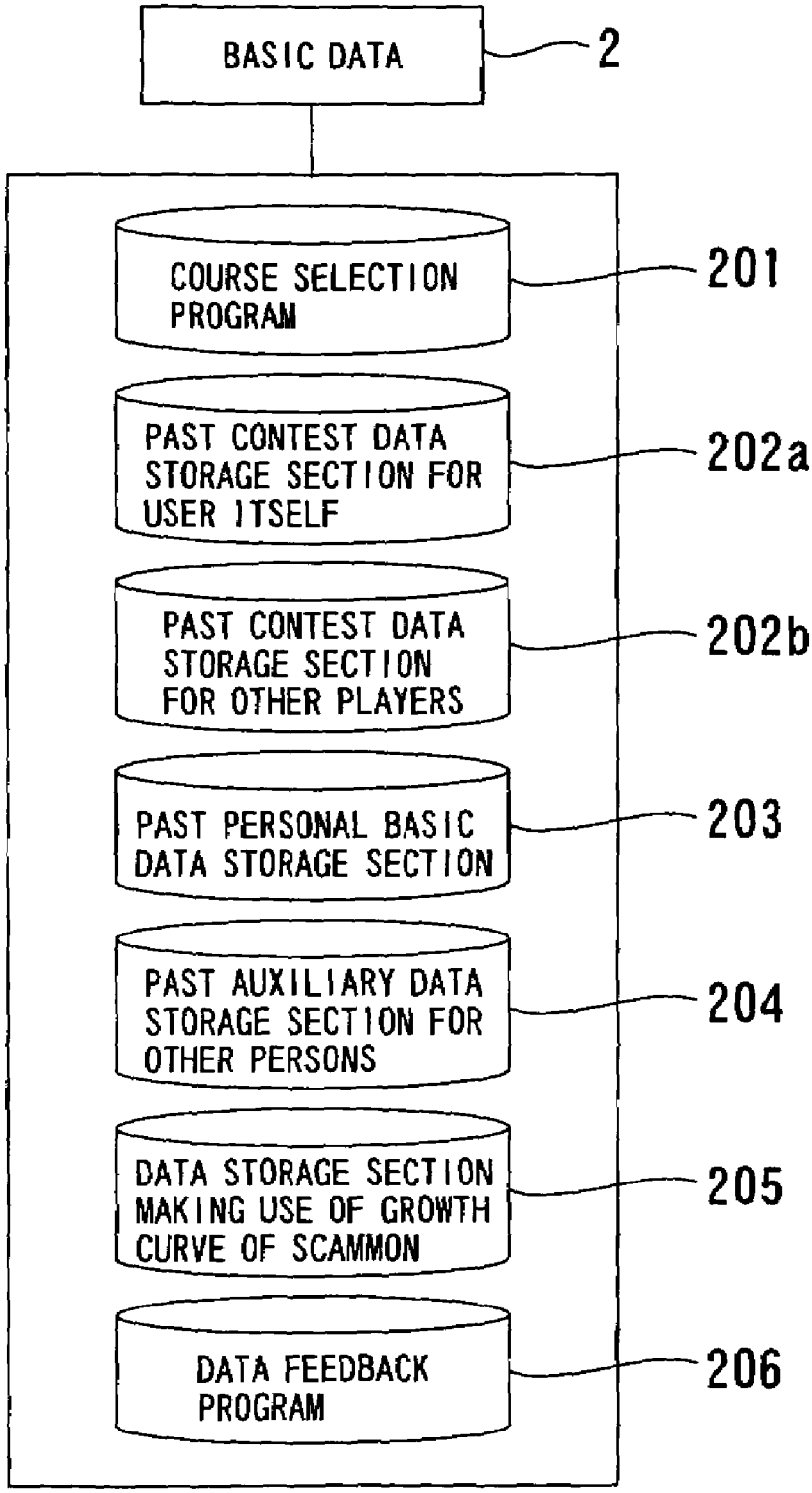
Figure 1C:
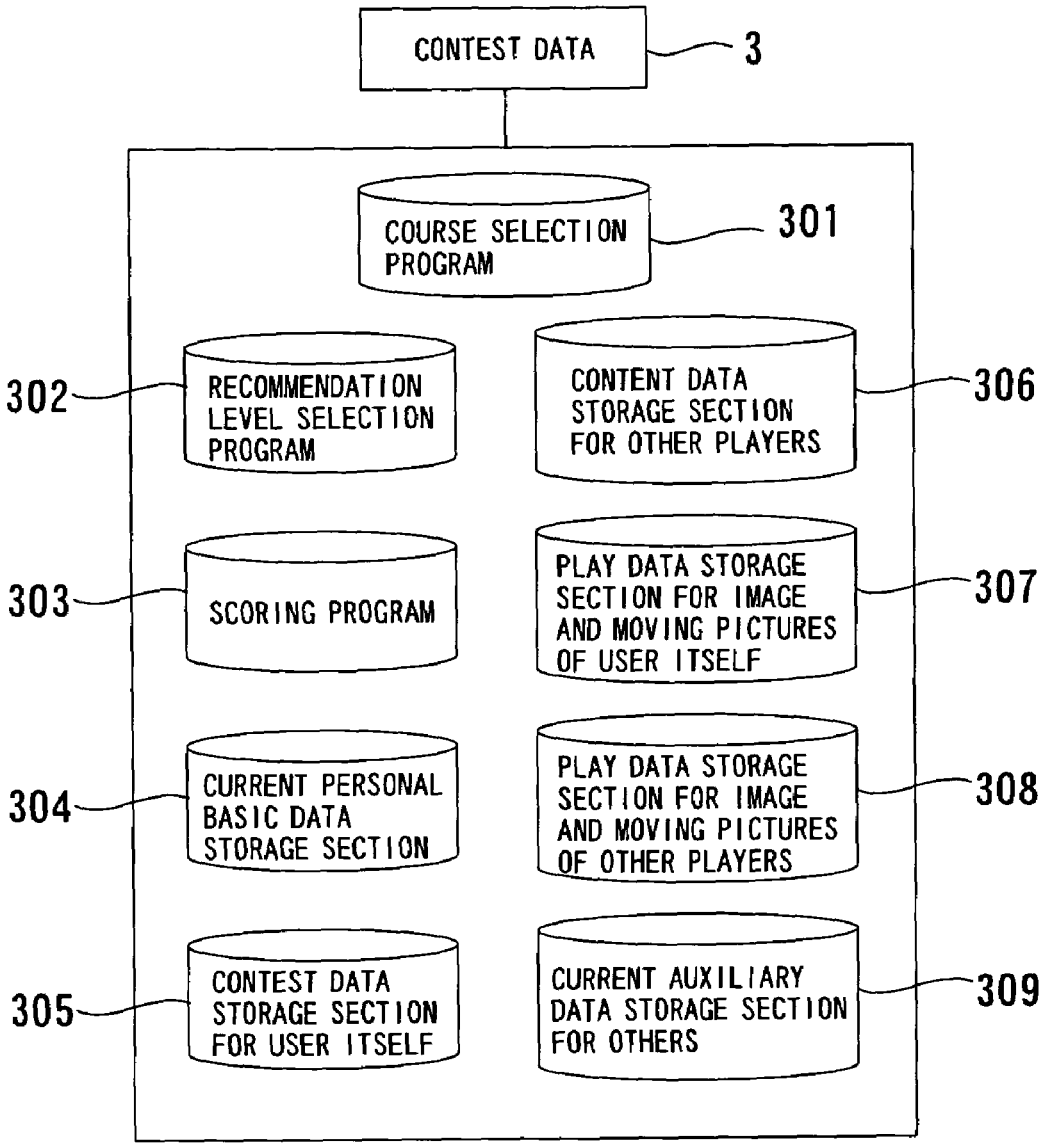
Figure 1D:
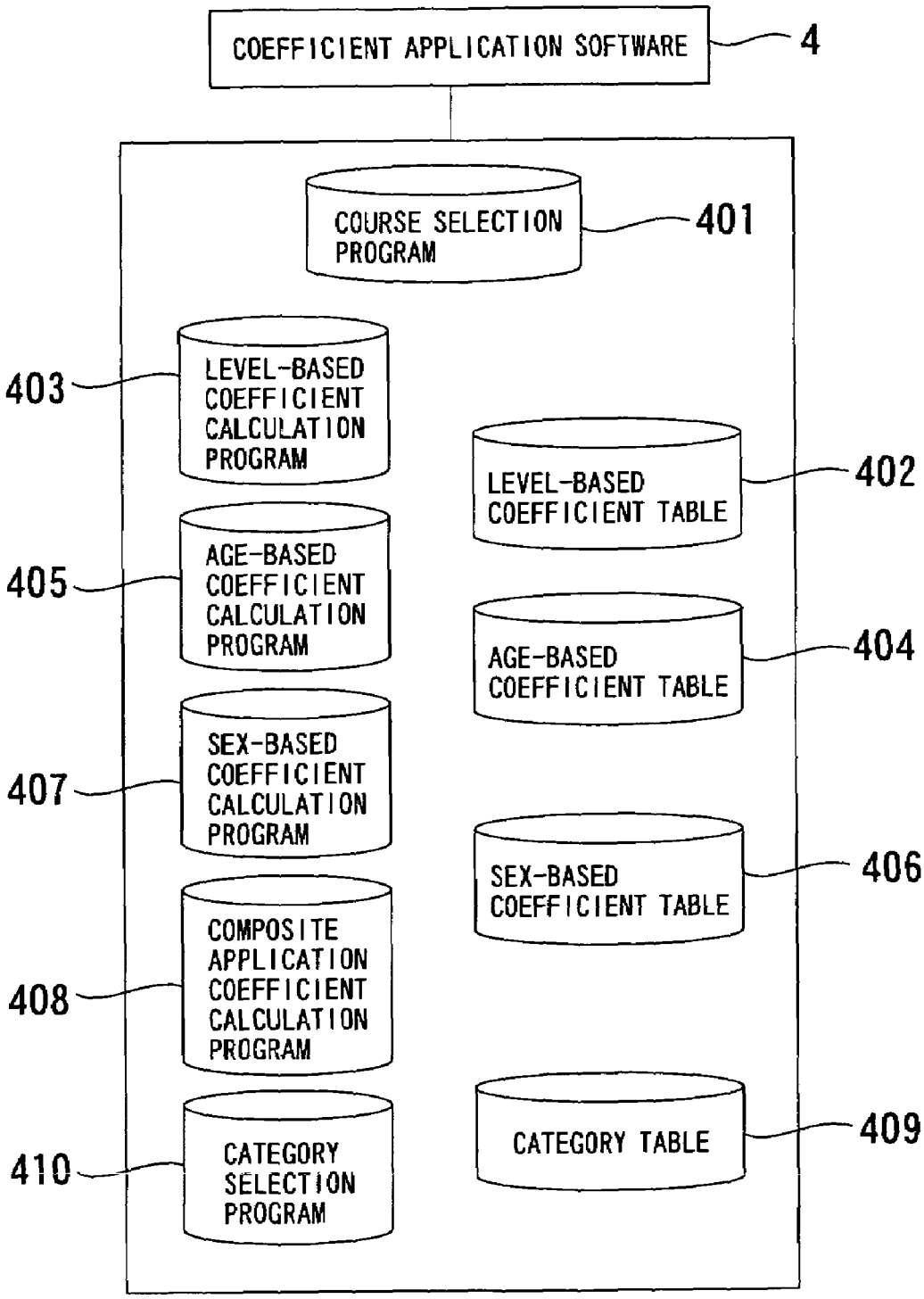
Figure 1E:
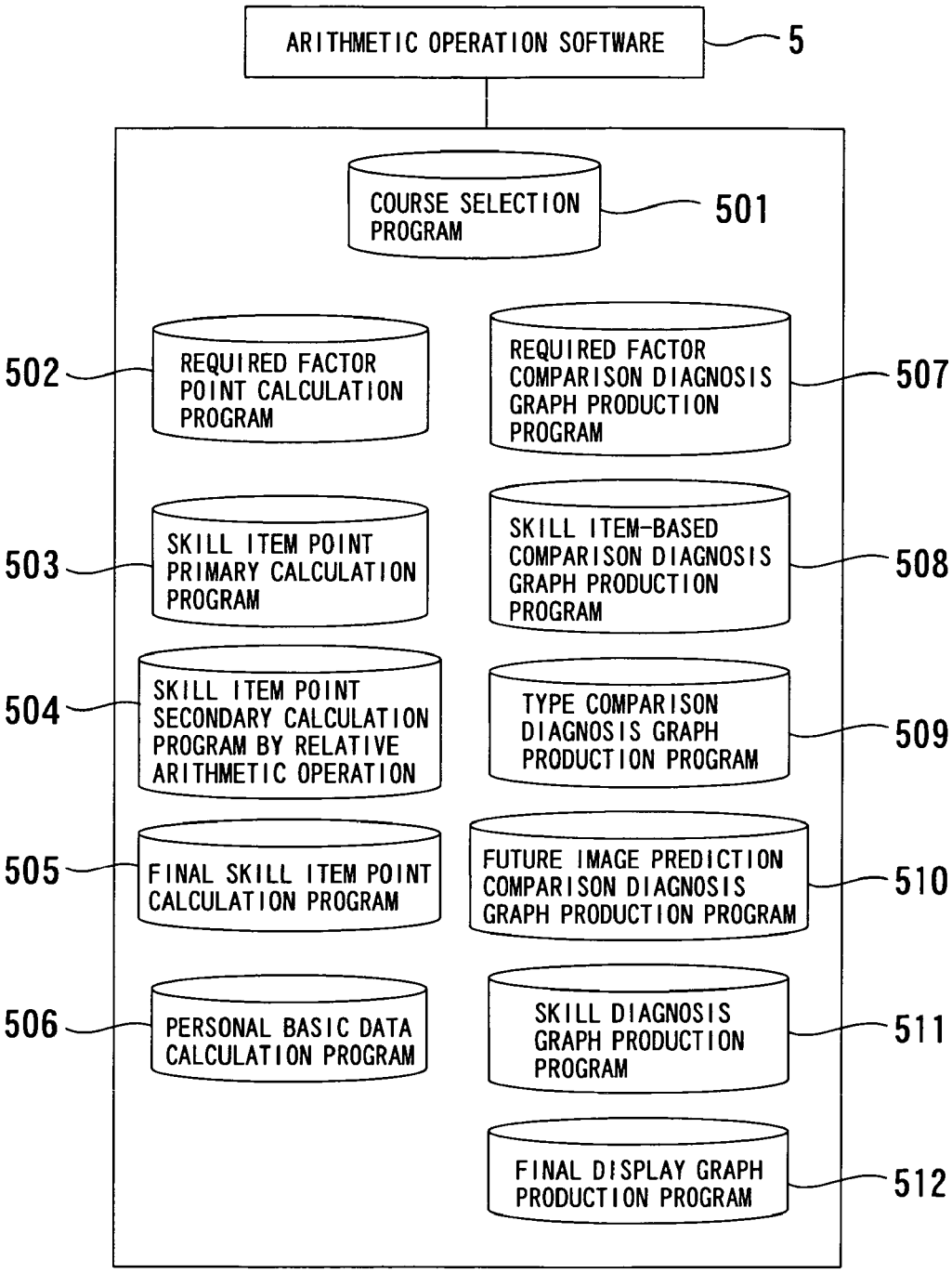
Figure 1F:
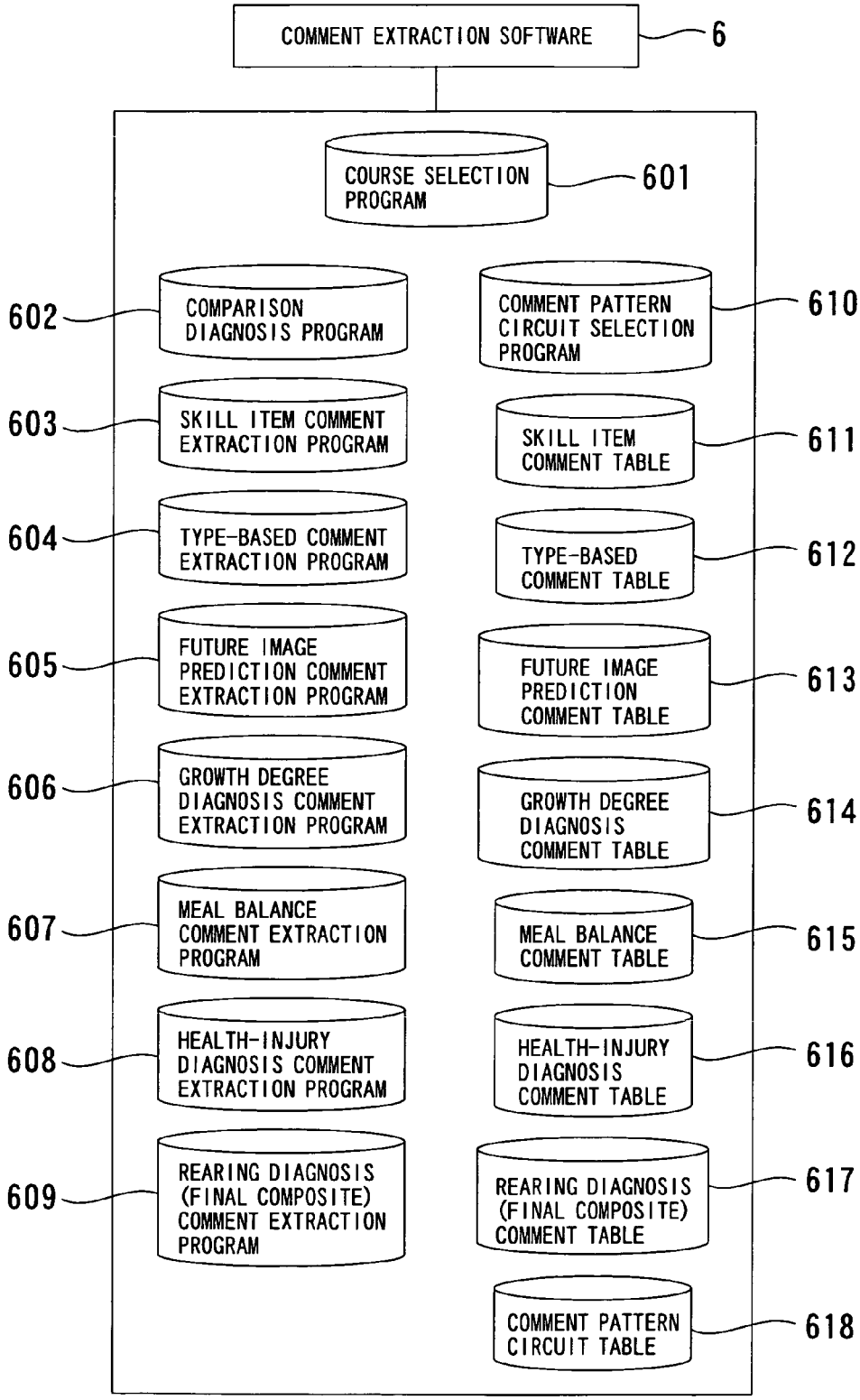

FIG. 1(A) to FIG. 1(F) show an example of a general configuration of a sports skill evaluation system to which the present invention is applied. In the present system, various data are managed collectively by a main computer 1 in accordance with a program (software) stored in a recording or storage medium. In particular, a basic database 2 and a contest database 3 are managed by the main computer 1 in accordance with coefficient application software 4 including a coefficient table, arithmetic operation software 5 for various arithmetic operations, and comment extraction software 6 including a comment table. The basic database 2 includes an external and/or internal recording or storage media such as a hard disk, a CD-ROM, a DVD or a semiconductor memory in which basic data of a user and so forth are stored. The contest database 3 includes a recording or storage medium in which data of a recent contest of various sports are stored similarly.

An inputting/outputting apparatus 7 including a keyboard and a display unit belongs to the main computer 1 and can input data to the main computer 1 therethrough. Data can be inputted to the main computer 1 also from external inputting/outputting apparatus 9 such as personal computers, portable terminals and so forth connected through the Internet 8. Furthermore, data relating to a contest can be inputted also from an external inputting/outputting apparatus 11 through a network 10 for exclusive use. The inputting/outputting apparatus 7 and 11 can input personal basic data, match results and so forth of the user (including levels and match experience regarding the sports, age, sex and score) to the main computer 1. Further, where data are stored in such a storage medium as an IC tag, a contactless IC card or the like, data can be inputted to the main computer 1 also from an inputting/outputting apparatus 12 for reading such a storage medium as just mentioned. Further, personal basic data can be inputted also from the external inputting/outputting apparatus 9 connected through the Internet 8 making use of a web site which is laid open.

The basic database 2 includes a course selection program 201 for managing data in accordance with a selected course, a contest data storage section 202*a* for storing contest data of the user itself in the past, a contest data storage section 202*b* for storing contest data of other players, a personal basic data storage section 203 for storing personal basic data in the past, an auxiliary data storage section 204 for storing auxiliary data of other persons in the past, a data storage section 205 which makes use of a growth curve of Scammon, and a data feedback program 206.

The contest database 3 includes a course selection program 301 for managing data in accordance with a selected course, a selection program 302 for selecting a recommendation level for the user, a scoring program 303 for scoring inputted contest data, a personal basic data storage section 304, a contest data storage section 305 for the user itself, a content data storage section 306 for other players, a play data storage section 307 for an image and moving pictures of the user itself, a play data storage section 308 for an image and moving pictures of other players, and a current auxiliary data storage section for others 309.

The coefficient application software 4 includes a course selection program 401 for determining a category and coefficients in accordance with a selected course, a level-based coefficient table 402, a level-based coefficient calculation program 403 for referring to level-based coefficients of the level-based coefficient table 402, an age-based coefficient table 404, an age-based coefficient calculation program 405 for referring to age-based coefficients of the age-based coefficient table 404, a sex-based coefficient table 406, a sex-based coefficient calculation program 407 for referring to sex-based coefficients of the sex-based coefficient table 406, a composite application coefficient calculation program 408 for calculating a composite application coefficient from such various coefficients as mentioned above, a category table 409 wherein categories of the level, age and sex are classified, and a category selection program 410 for selecting one of the categories.

The arithmetic operation software 5 includes a course selection program 501 for determining an arithmetic operation program in accordance with a course or a category selected on the main computer 1, a required factor point calculation program 502 for calculating a point for each required factor such as a technique necessary to perform a match from a score of a result of the match, a skill item point primary calculation program 503 for calculating a point for each skill item separately as a skill item point which can be settled primarily and a temporary skill item point from a required factor point in order to perform multi-phase skill evaluation, and a skill item point secondary calculation program 504 for calculating a relative skill item point by relative arithmetic operation from such points as mentioned above and calculating a skill item point settled secondarily for all of the skill items. The arithmetic operation software 5 further includes a final skill item point calculation program 505 for calculating a composite final skill item point from the skill item point and personal application coefficients calculated by the coefficient application software 4 as well as the composite application coefficient by collecting the personal application coefficients, a personal basic data calculation program 506 for performing comparison arithmetic operation with the basic database 2, a required factor comparison diagnosis graph production program 507 for producing a required factor comparison diagnosis graph regarding the match based on the calculated required factor point, and a skill item-based comparison diagnosis graph production program 508 for producing a skill item-based comparison diagnosis graph based on the secondarily settled skill item points. The arithmetic operation software 5 further includes a type comparison diagnosis graph production program 509 for extracting required factors for a particularly high point and required factors for a particularly low point and producing a type comparison diagnosis graph in which the resulting required factors are collected, a future image prediction comparison diagnosis graph production program 510 for producing, based on a particular age condition of the user, a future image prediction comparison diagnosis graph which makes use of a growth curve of Scammon or an age-based coefficient, a skill diagnosis graph production program 511 for producing a skill diagnosis graph based on the skill item points, and a final display graph production program 512 for producing a final display graph to be displayed finally on the display screen.

The comment extraction software 6 includes a course selection program 601 for determining a comment extraction program in accordance with a course or a category selected on the main computer 1, a comparison diagnosis program 602 for collating and comparing data of the basic database 2 with such diagnosis graphs as described hereinabove by the arithmetic operation software 5, a skill item comment extraction program 603 for extracting a skill item comment (particular evaluation substance for each skill item) from a comment table in which such skill item comments are stored, and a type-based comment extraction program 604 for extracting a type-based comment (particular type-based evaluation substance) from a comment table in which such type-based comments are stored. The comment extraction software 6 further includes a future image prediction comment extraction program 605 for extracting a future image prediction comment from a comment table in which such future image prediction comments are stored, a growth degree diagnosis comment extraction program 606 for extracting a growth degree diagnosis comment from a comment table in which such growth degree extraction comments are stored, a meal balance comment extraction program 607 for extracting a balance comment of meals from a comment table in which such balance comments of meals are stored, a health-injury diagnosis comment extraction program 608 for extracting a diagnosis comment of the health or an injury from a comment table in which such diagnosis comments of the health or an injury are stored, and a rearing diagnosis comment extraction program 609 for extracting a final rearing diagnosis comment from a comment table in which such final rearing diagnosis comments are stored.

The comment extraction software 6 further includes a comment pattern circuit selection program 610 for converting the level, match experience, age, sex and so forth of the user, categorizing them and calculating a comment pattern designation value for selecting a comment pattern circuit from the values for each skill item in accordance with a predetermined calculation expression, a skill item comment table 611 in which skill item comments are stored, a type-based comment table 612 in which type-based comments are stored, and a future image prediction comment table 613 in which future image prediction comments are stored. The comment extraction software 6 further includes a growth degree diagnosis comment table 614 in which growth degree diagnosis comments are stored, a meal balance comment table 615 in which balance comments of meals are stored, a health-injury diagnosis comment table 616 in which health-injury diagnosis comments are stored, a rearing diagnosis comment table 617 in which final rearing diagnosis comments are stored, and a comment pattern circuit table 618 in which rules for selecting a comment pattern circuit are stored.

Each of the comment extraction programs 603 to 609 refers to the comment pattern circuit table 618 to extract a comment of a number corresponding to a comment pattern designation value calculated by the comment pattern circuit selection program 610 from a pertaining comment table.

In the following, a flow of processes executed by the system having such a configuration as described above is described with reference to flow charts of FIGS. 2 to 10.

Figure 2:
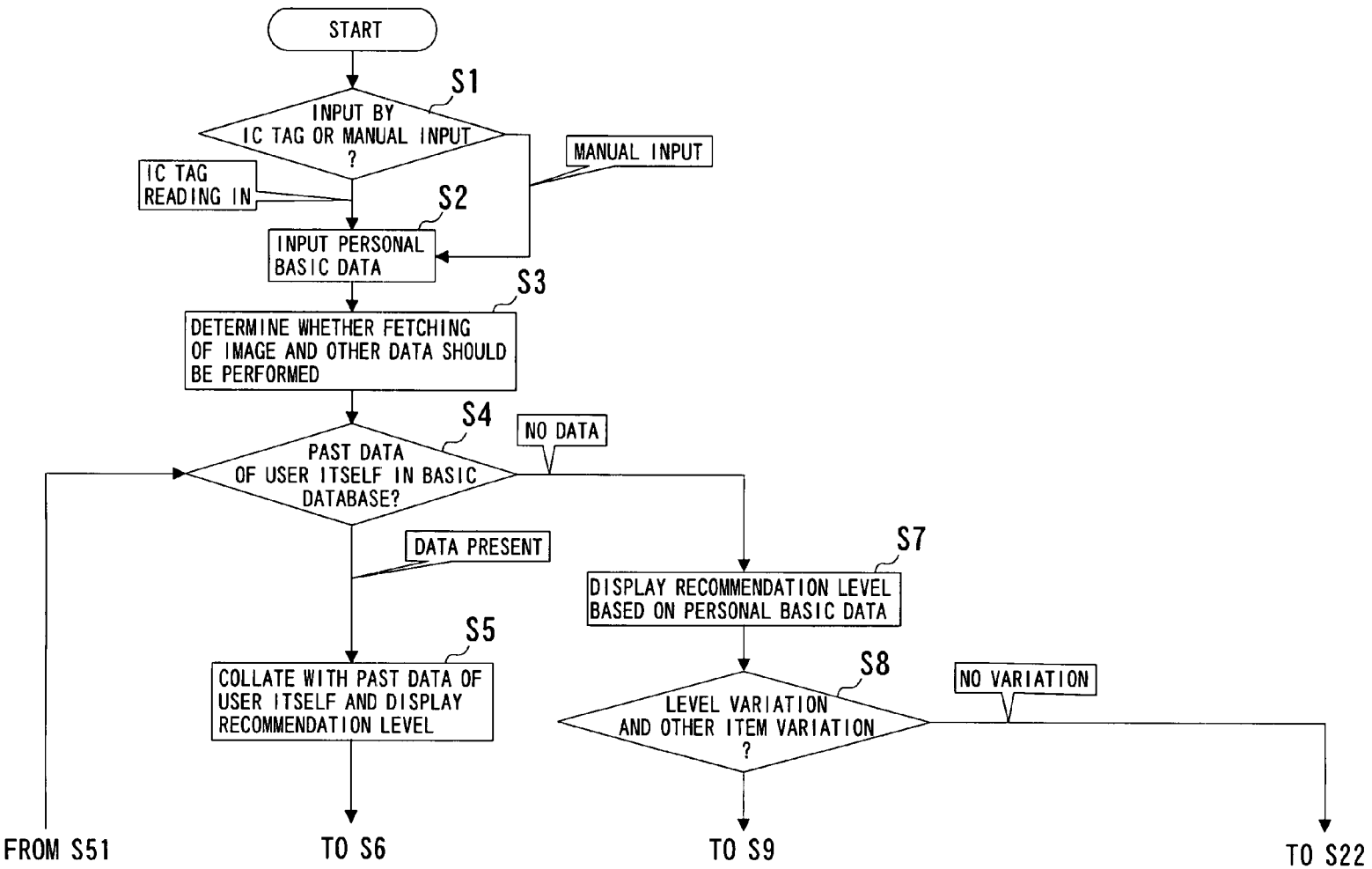
FIGS. 2 to 10 are flow charts illustrating a processing procedure of the sports skill evaluation system of FIG. 1(A) to FIG. 1(F)

Referring first to FIG. 2, the system decides first at step S1 whether it is in an IC tag input mode or a manual input mode. In the former case, the personal basic data stored already are read in using the inputting/outputting apparatus 12, but in the latter case, data inputted from the keyboard or a touch panel are determined as personal basic data (step S2). Then, it is decided whether or not fetching of images and other data should be performed (step S3).

Then at step S4, it is decided whether or not the basic database includes past data of the user itself. If past data exist, then the personal basic data are collated with the past data of the user itself and a recommendation level is displayed (step S5). Then at step S6 shown in FIG. 3, it is confirmed whether or not level variation or variation of some other item should be performed.

On the other hand, if the past data do not exist in the basic database at step S4, then a recommendation level based on the inputted personal basic data is displayed (step S7). Then at step S8, it is confirmed whether or not level variation or variation of some other item should be performed.

Figure 3:
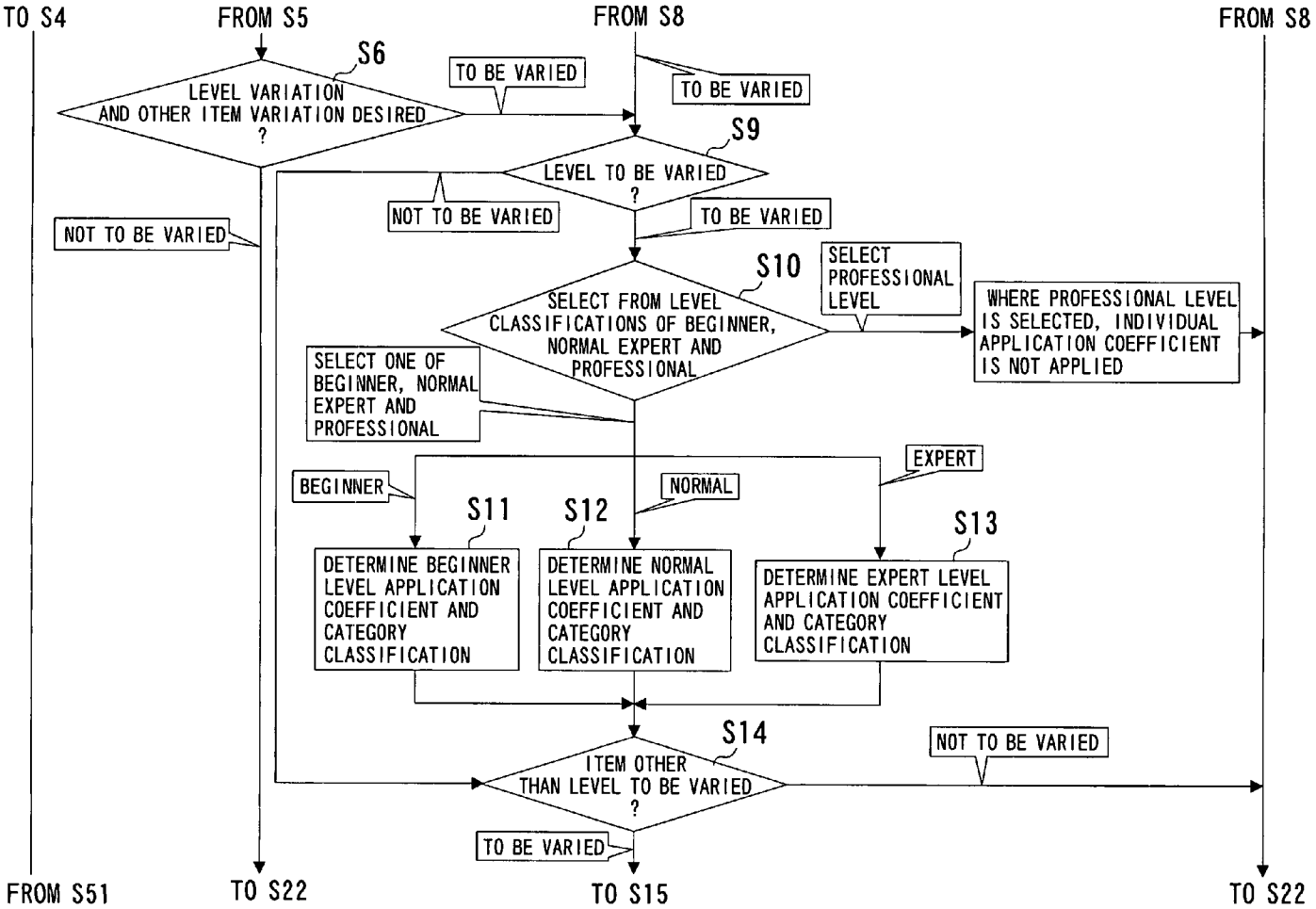
Figure 4:
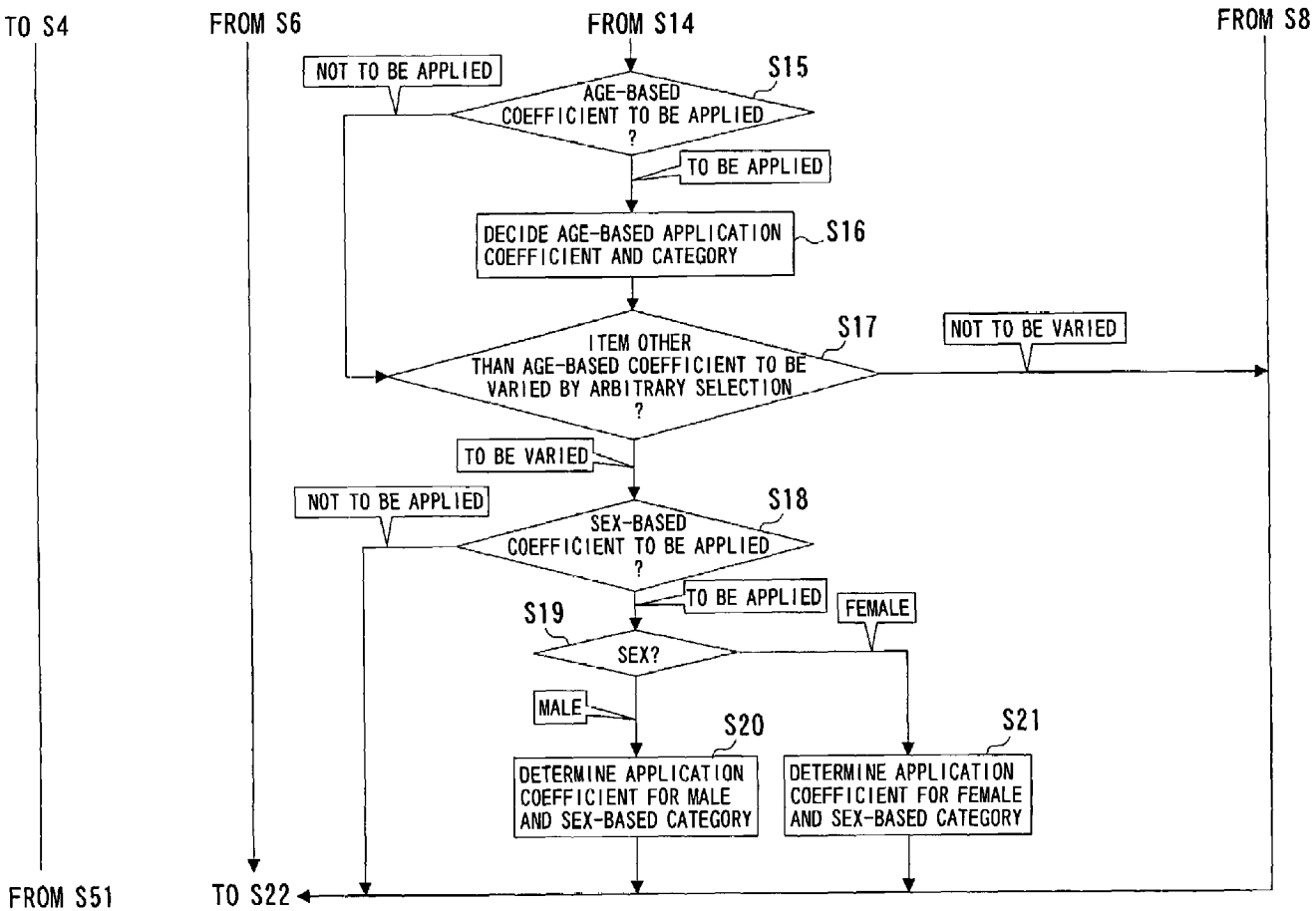
Figure 5:
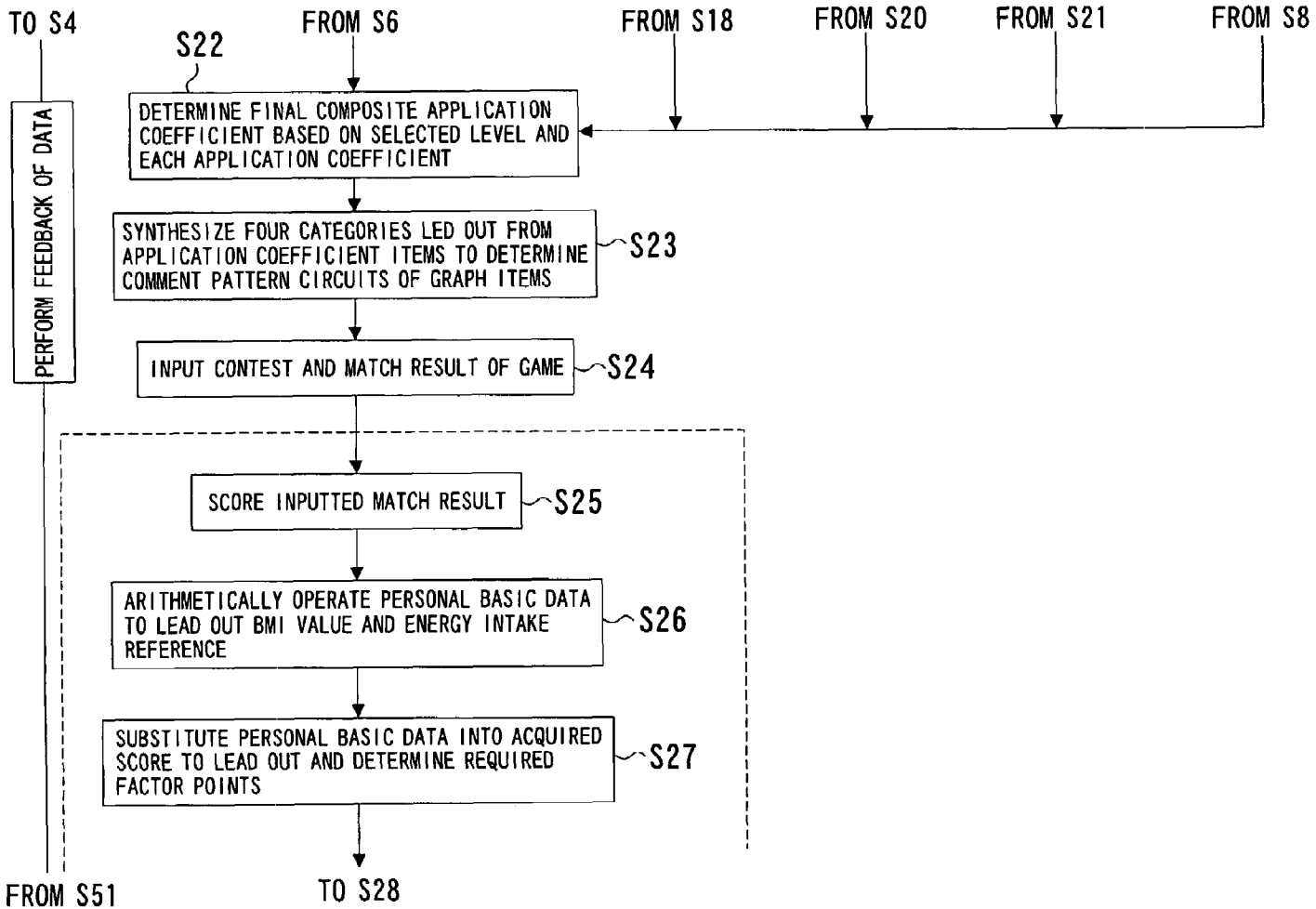
Figure 6:
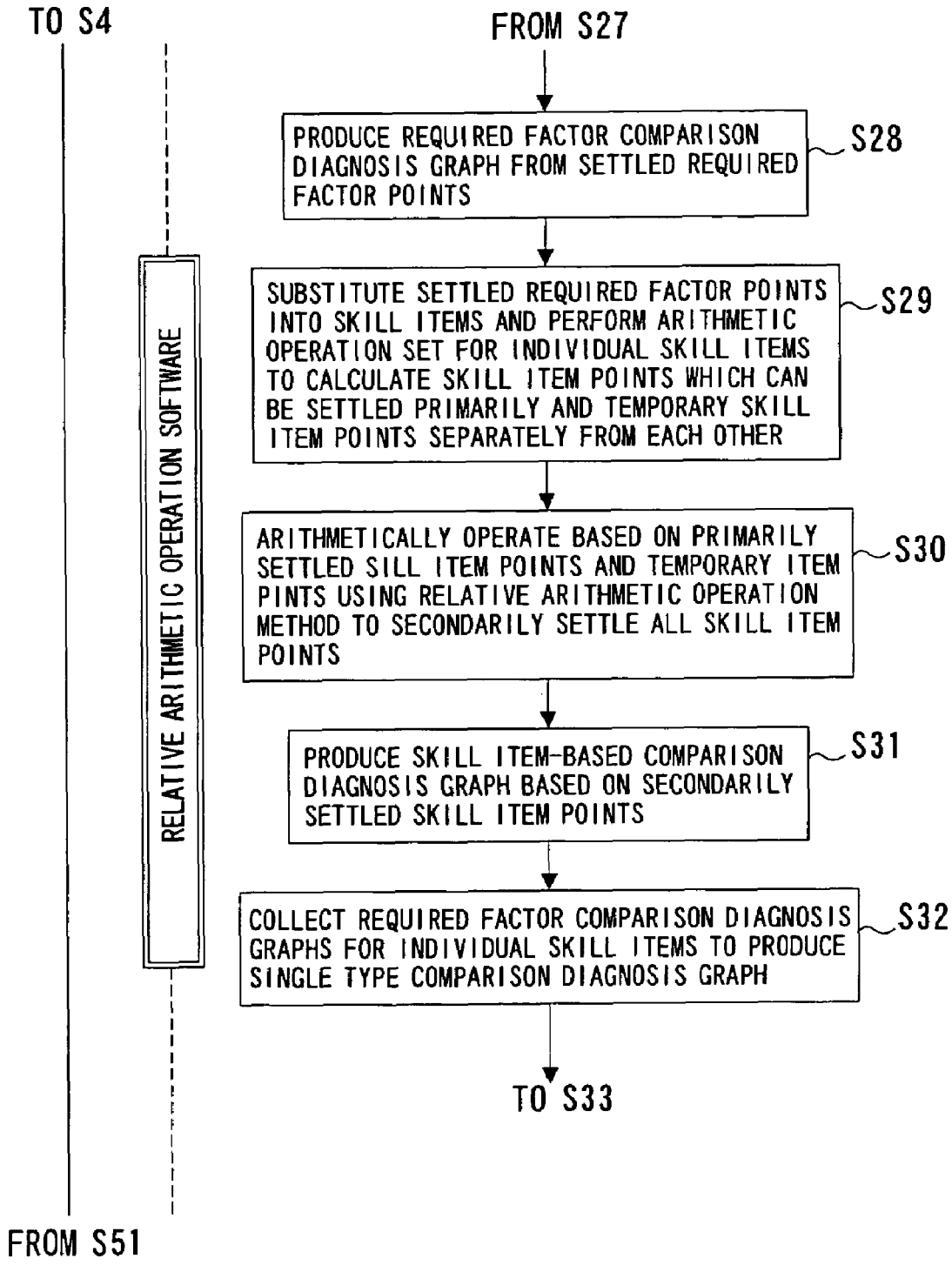
Figure 7:
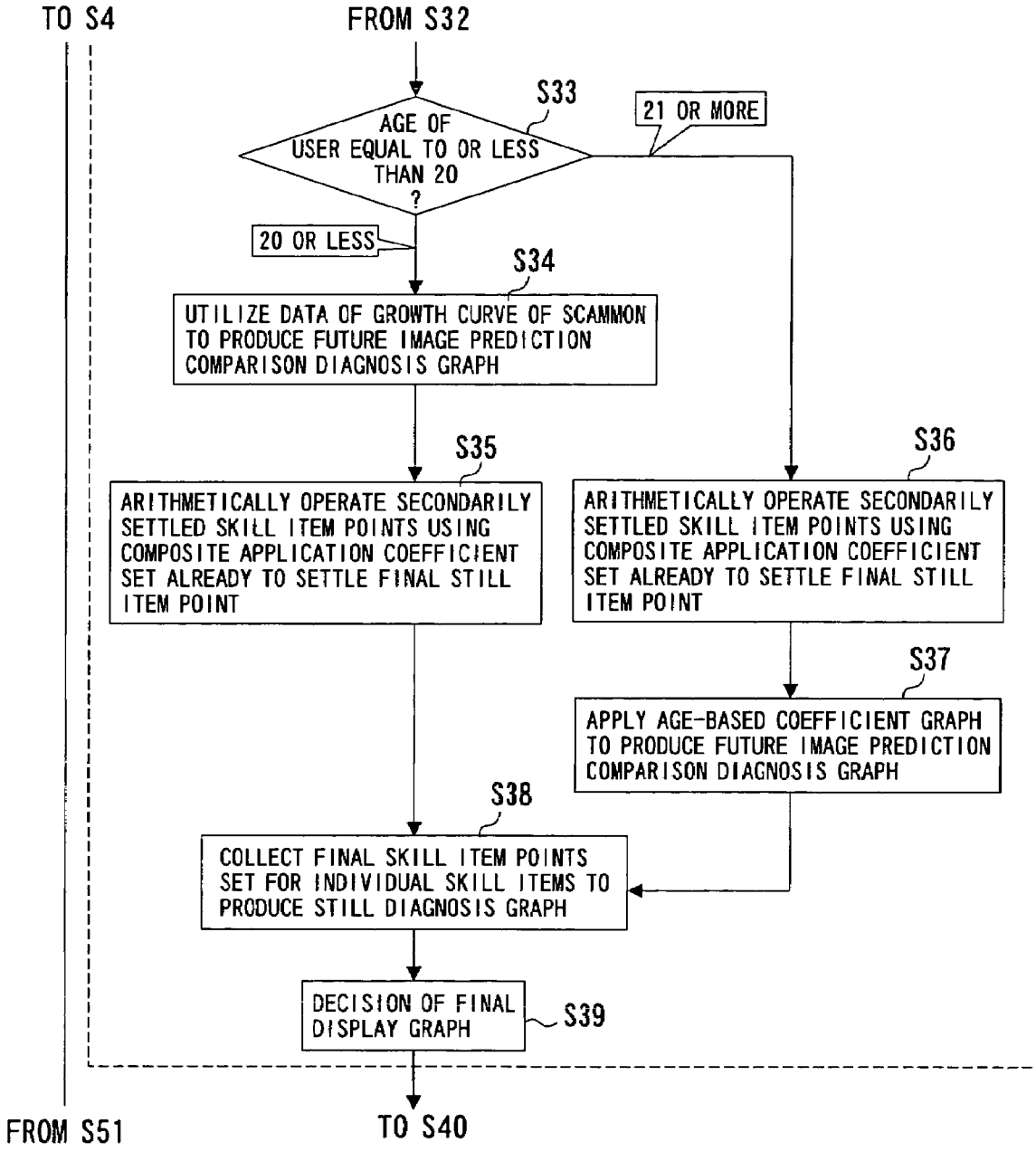
Figure 8:
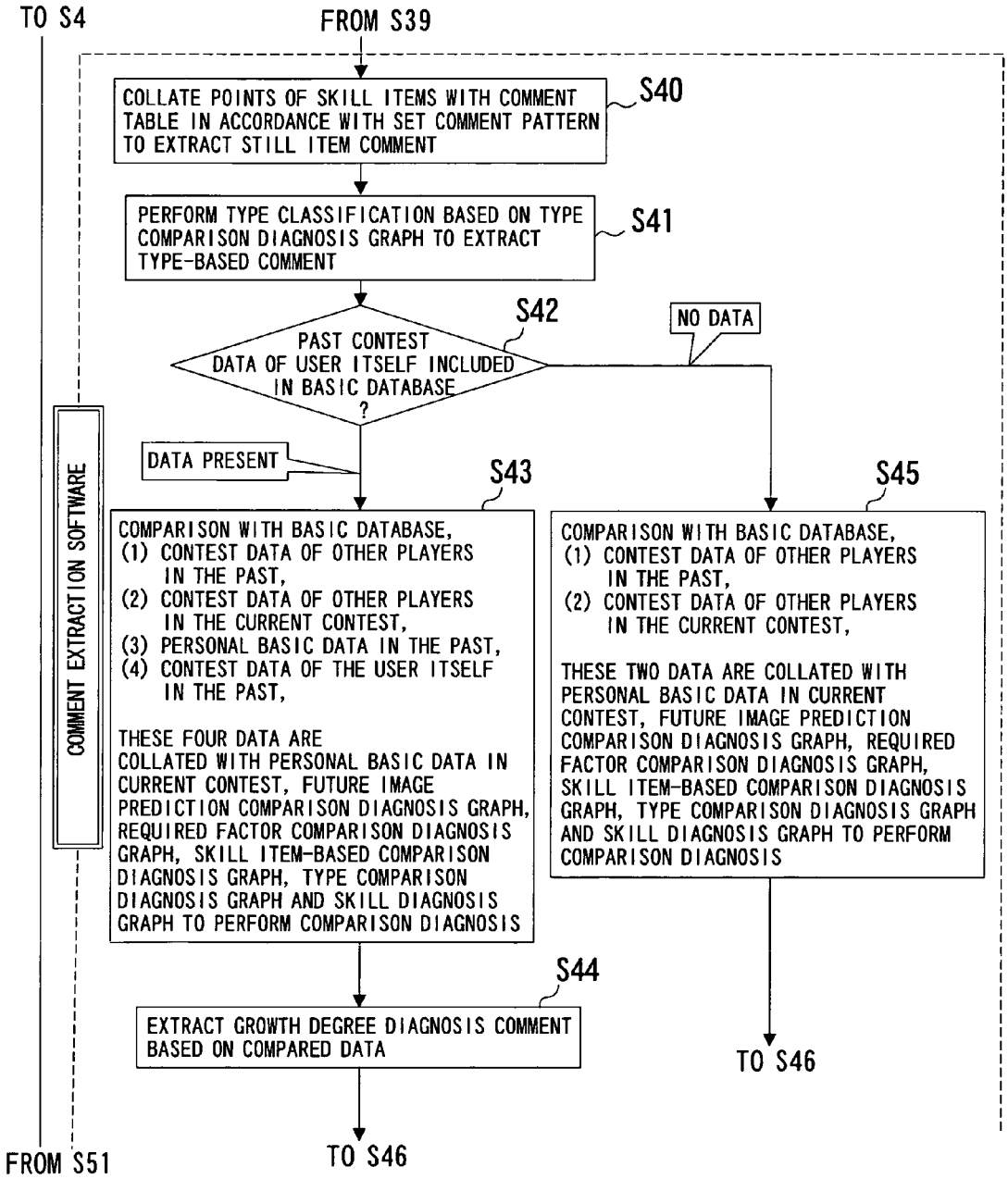
Figure 9:
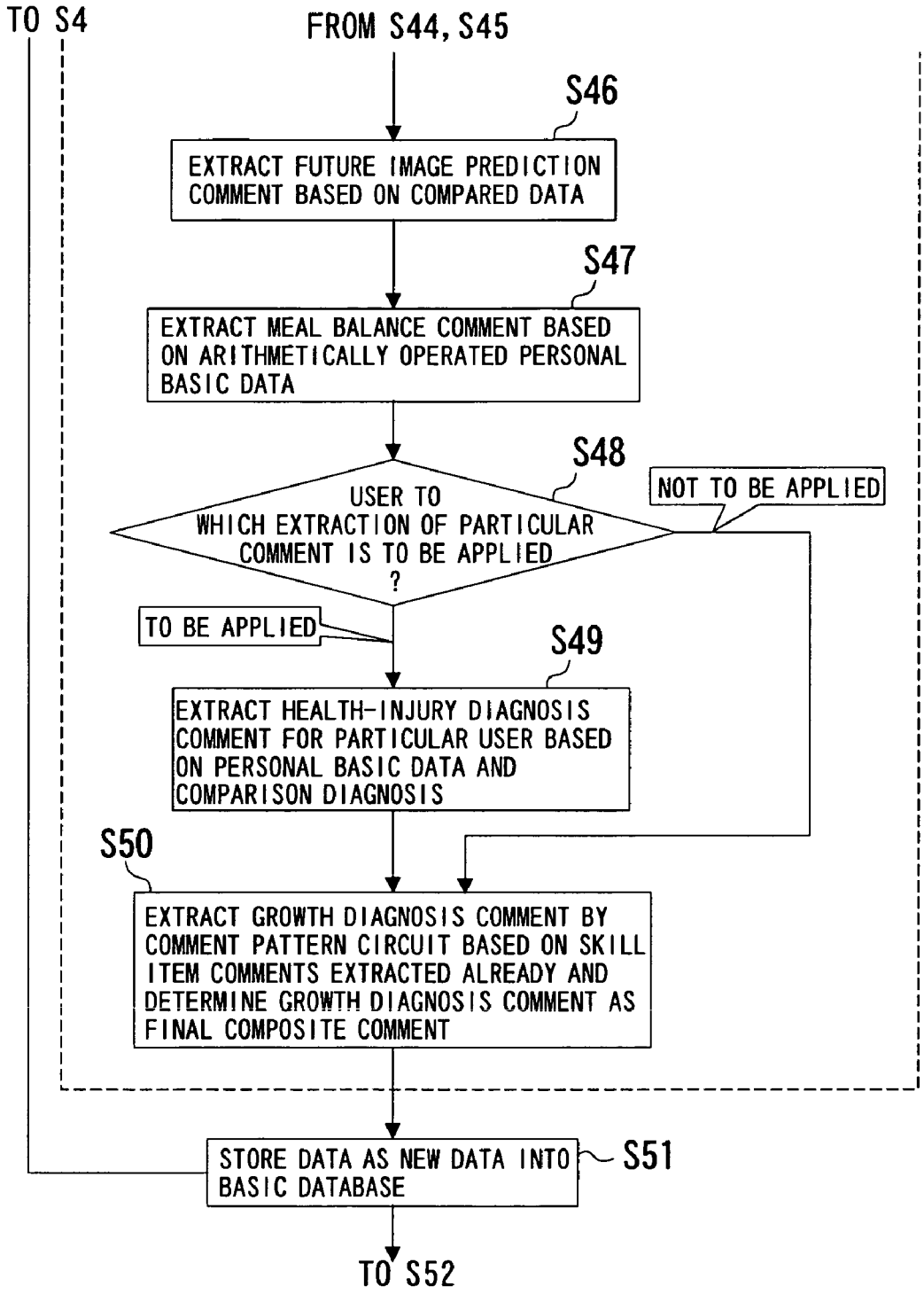
Figure 10:
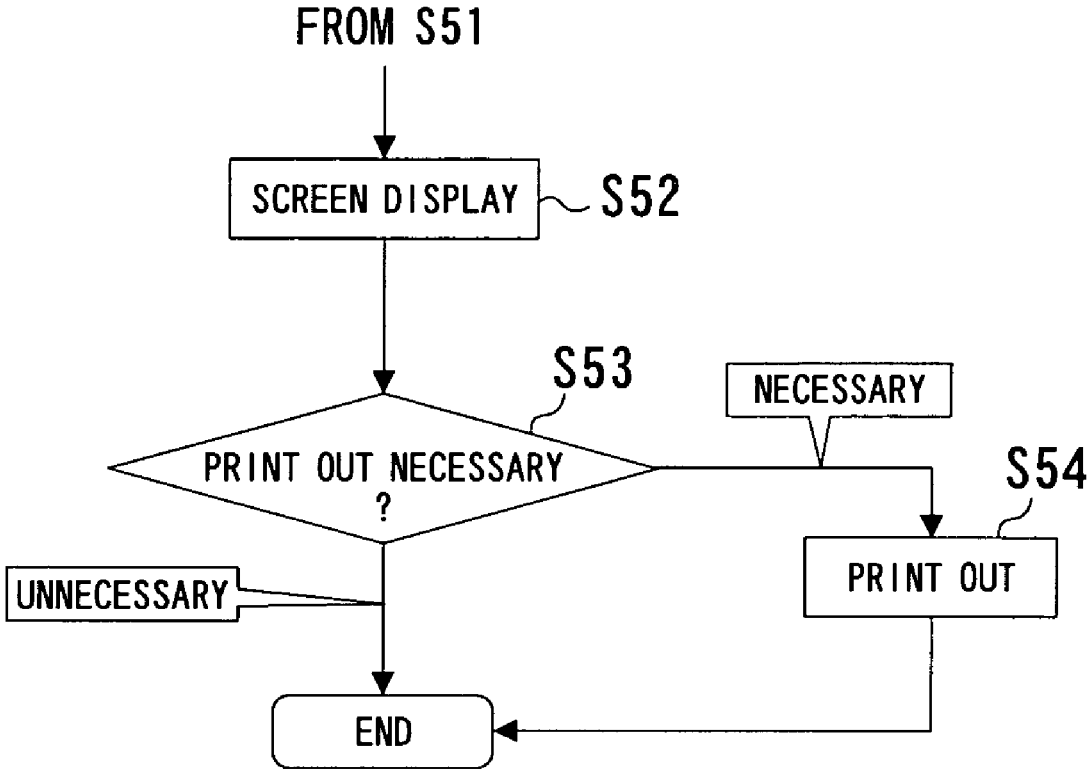

Then, if it is decided at step S9 shown in FIG. 3 that the level should be varied, then it is decided at step S10 which one of levels of "beginner", "normal", "expert" and "professional" is selected as a category classification regarding the level.

If the "beginner" level is selected, then a category and an individual application coefficient regarding the beginner level are determined at step S11. If the "normal" level is selected, then a category and an individual application coefficient regarding the normal level are determined at step S12. If the "expert" level is selected, then a category and an individual application coefficient regarding the expert level are determined at step S13. In this manner, classification of categories is performed based on the individual application coefficient for each level. A comment to be applied for each level is selected based on the category as hereinafter described. If the "professional" level is selected, application of such an individual application coefficient as described above is not performed.

At next step S14, it is decided whether or not an item other than the level should be varied. If an item other than the level should be varied, then it is decided at step S15 whether or not an age-based coefficient categorized with regard to the age should be applied. If the age-based coefficient should be applied, then a category and an age-based application coefficient (individual application coefficient) of a corresponding age classification at step S16. Then at step S17, it is decided whether or not some item by arbitrary selection other than the age should be varied. If some other item should be varied, then it is decided at step S18 whether or not a sex-based coefficient according to a classification with regard to the sex should be applied. If the sex-based coefficient should be applied, then the sex is decided from between the male and the female at step S19. If the user is the male, then a category and an application coefficient (individual application coefficient) for the male are decided at step S20, but if the user is the female, then a category and an application coefficient (individual application coefficient) for the female are decided at step S21.

Then at step S22, a composite application coefficient is decided based on the individual application coefficients decided in such a manner as described above. At step S23, a category is selected within each application coefficient item (level, match experience, generation and sex), and the four categories are synthesized to decide a comment pattern circuit. In particular, in order to select a comment for each of skill items which are particular evaluation and rearing diagnosis substances separately for each category for each application coefficient item, a category is selected one by one from the individual items to select a comment pattern circuit. Here, the skill items are items to be used as a reference for evaluation of the skill regarding the match as described hereinabove and may be, for example, the technique, decision power, judgment, physical, sense, creativity, spirit, potential skill, offensive power, defensive power, body balance, fantajista degree, tactics (strategy understanding) and so forth.

Figure 11:
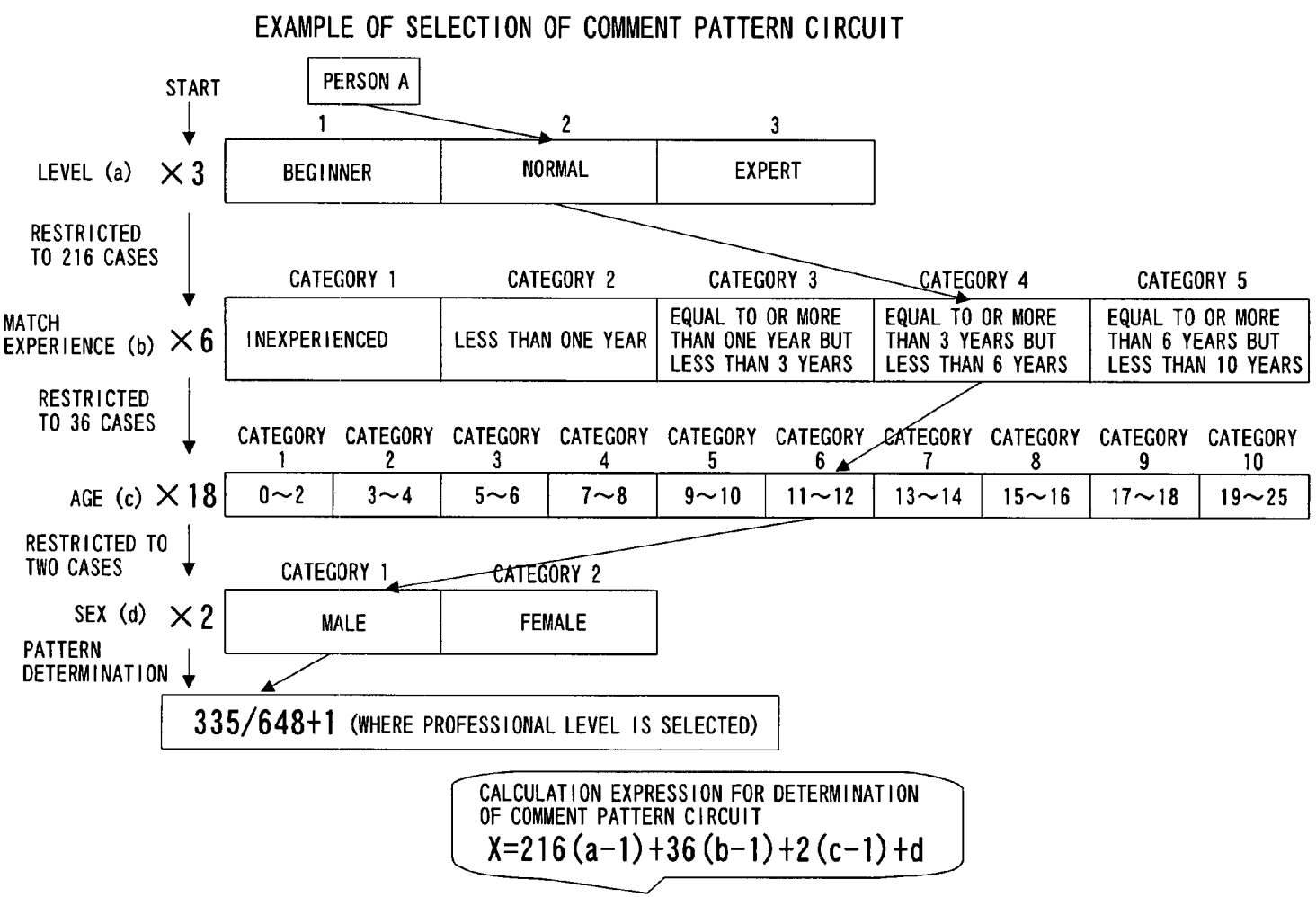
FIG. 11 is a diagrammatic view illustrating an example of a determination procedure of a comment pattern circuit.

FIG. 11 schematically illustrates an example of a determination procedure of a comment pattern circuit.

Referring to FIG. 11, for the level, one of the three categories of beginner, normal and expert is selected with a numerical value of 1, 2 or 3 and substituted into a parameter a. For the match experience, one of six categories of inexperienced, less than one year, equal to or more than one year but less than 3 years, equal to or more than 3 years but less than 6 years, equal to or more than 6 years but less than 10 years and equal to or more than 10 years is selected with a numerical value of one of 1 to 6 and substituted into another parameter b. For the age, one of 18 categories delineated for each two years is selected with a numeral value of one of 1 to 18 and substituted into a further parameter c. For the sex, one of the two categories of male and female is selected with a numerical value of 1 or 2 and substituted into a still further parameter d.

Where the comment pattern designation value is represented by X, the Xth comment pattern designation value from among 649 comment pattern circuits is determined, for example, in accordance with a calculation expression of $$X=216(a-1)+36(b-1)+2(c-1)+d$$

As a particular example, a flow of processes until a comment on the technique which is one of the skill items is extracted where a user A participates in a contest is illustrated from above in FIG. 12.

In the case of the person A, the level is normal, and therefore, the parameter a is 2 from FIG. 11: the match experience is four years, and therefore, the parameter b is 4; the age is 12, and therefore, the parameter c is 6; and the sex is the male, and therefore, the parameter d is 2. Thus, by substituting the values into the calculation expression for the comment pattern designation value given above, $$X=216(2-1)+36(4-1)+2(6-1)+1=335$$

is obtained. Consequently, from among the 649 comment pattern circuits, a comment pattern circuit wherein the comment pattern designation value is 335 and which is suitable for the person A is selected. Then, for example, the following comment is presented:

"The age of you is that which is exactly called golden age and in which anything can be absorbed immediately. At the present point of time, you are superior in dribble and ball control techniques, but seem to have a subject in accuracy. In order to exhibit the techniques you have, you should acquire highly accurate play and rapid judgment!".

After a comment pattern circuit is selected in this manner at step S23, a result of a match in the contest (or game) would be inputted at step S24. Consequently, the inputted gate result is converted into a score at step S25, and then at next step S26, calculation of a known BMI index representative of the ponderal index and calculation of an energy intake reference are performed based on the personal basic data.

Figure 13:
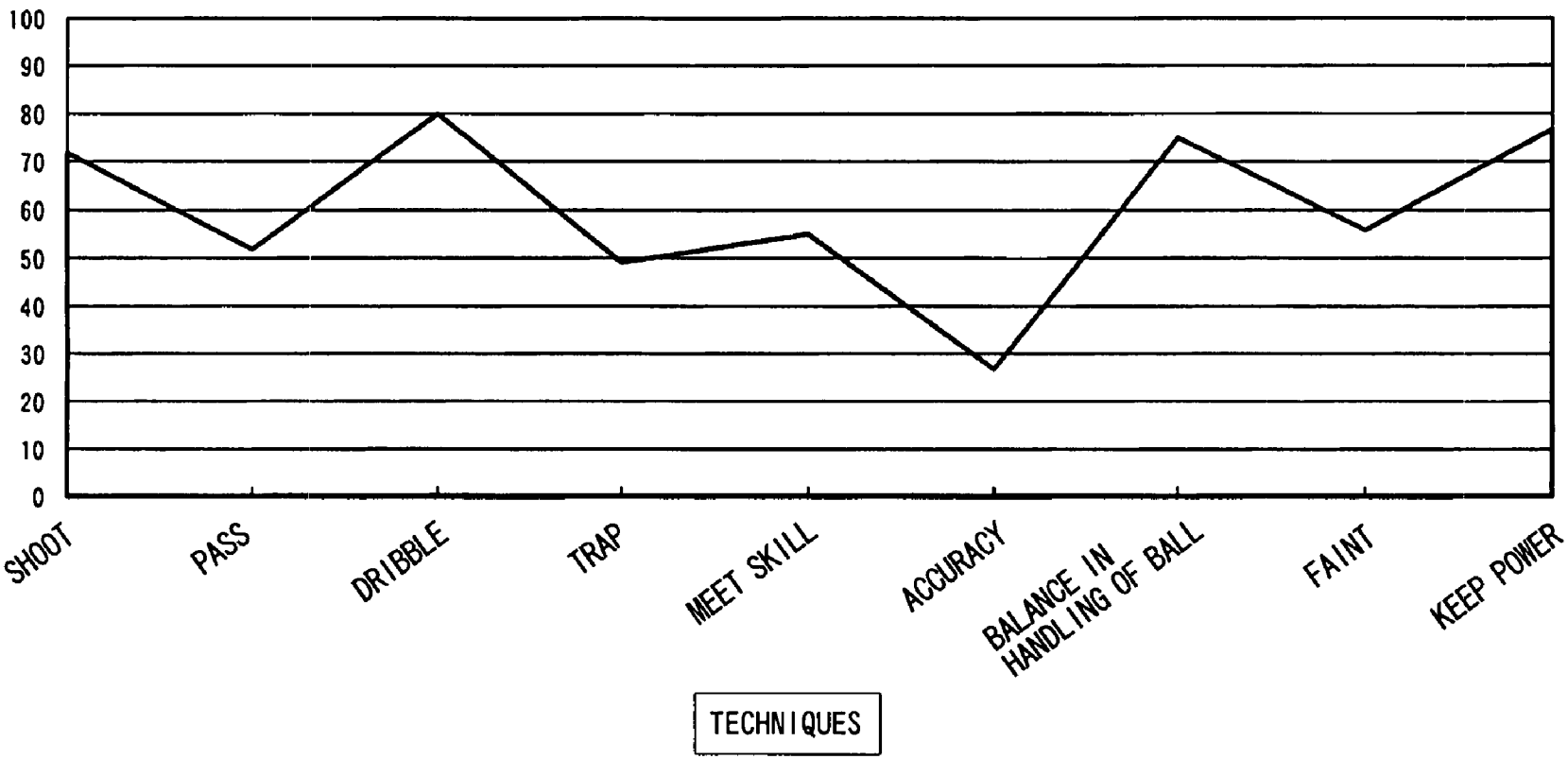
FIG. 13 is a diagram illustrating an example of a required factor diagnosis graph.

Then at step S27, the personal basic data are included into the acquired score with regard to the contest (game) to lead out a point (required factor point) with regard to a required factor required to perform the match (game), for example, in the case of the technique item of the soccer, a point acquired with regard to a technique item such as a shoot or a pass. In addition, if the heart rate of the user in a normal state is stored in the basic database, then a point of a spiritual skill item of the user can be calculated through comparison between the heart rate and a heart rate in a particular situation created intentionally. Further, if a result of a health examination of the user is stored in the basic database, then it is possible to compare the result of the health examination with a particular coefficient stored in the coefficient table or the updated latest health examination result to calculate points of skill items relating to the health and the physical skill of the user. At next step S28, the points are graphed into a required factor comparison diagnosis graph in the form of a line graph, a bar graph, a plane graph (radar chart) of a polygonal shape (having a number of angles equal to the number of required factors in the technique item). An example of the required factor comparison diagnosis graph is shown in FIG. 13.

At step S29, the settled required factor points are substituted into a predetermined calculation expression for each skill item for determining each skill item to perform arithmetic operation for each skill item thereby to calculate those skill item points which can be settled primarily and temporary skill item points separately from each other.

Figure 14:
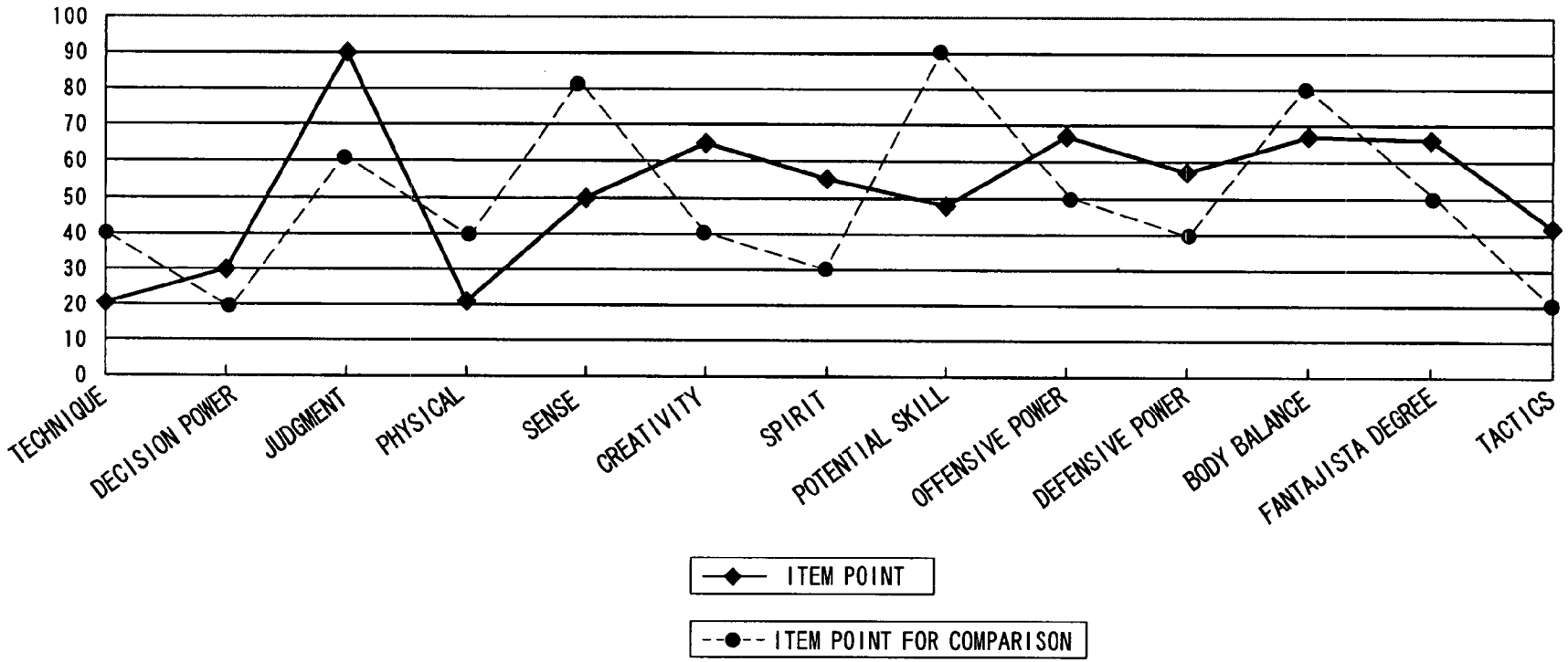
FIG. 14 is a diagram illustrating an example of a skill item-based comparison diagnosis graph.

Then at step S30, based on the primarily settled skill item points and the temporary skill item points, secondarily settled skill item points regarding all skill items are calculated in accordance with a relative arithmetic operation method. Thereafter, at step S31, a skill item-based comparison diagnosis graph is produced based on the skill item points. An example of the skill item-based comparison diagnosis graph is shown in FIG. 14. This graph is used for comparison with data of the user itself in the past or with data of other players.

Further, at step S32, particular required factors are extracted from the required factor comparison diagnosis graphs produced for the individual skill items, and a type comparison diagnosis graph for each type wherein the required factors are collected is produced. Since this graph is used for a comparison diagnosis with the type comparison diagnosis graph of another player, this is effective to make a forecast regarding what type player the user is or what type player the user may become in the future.

Then at step S33, it is decided whether or not the age of the user is equal to or less than 20. If the age of the user is equal to or less than 20, then a future image prediction comparison diagnosis graph is produced making use of the data of a growth curve of Scammon at step S34. Then at step S35, the secondarily settled skill item points and the individual application coefficients led out in such a manner as described hereinabove as well as the composite application coefficient which is the collection of the individual application coefficients are substituted into a predetermined calculation expression to calculate a final skill item point. Consequently, where the user is equal to or less than 20 years old, referring to the growth curve of Scammon which can be used as a standard for the physical growth amount, the final skill item point can be utilized, depending upon the individual skill items, as a material for judgment with regard to what skill is likely to extend or what skill is less likely to extend. The future image prediction comparison diagnosis graph is formed by including data of the growth curve of Scammon into the secondarily settle skill item points and converting the result into a graph. The form of the graph may be a polygonal graph, a graph obtained by dividing a polygonal graph, an ordinary line graph, bar graph or plane graph.

On the other hand, where the age of the user is equal to or more than 21, the secondarily settled skill item points and the composite application coefficient led out in such a manner as described hereinabove are substituted into a predetermined calculation expression to calculate a final skill item point similarly at step S36. Then at step S37,the age-based application coefficient is applied to produce a future image prediction comparison diagnosis graph.

Figure 15:
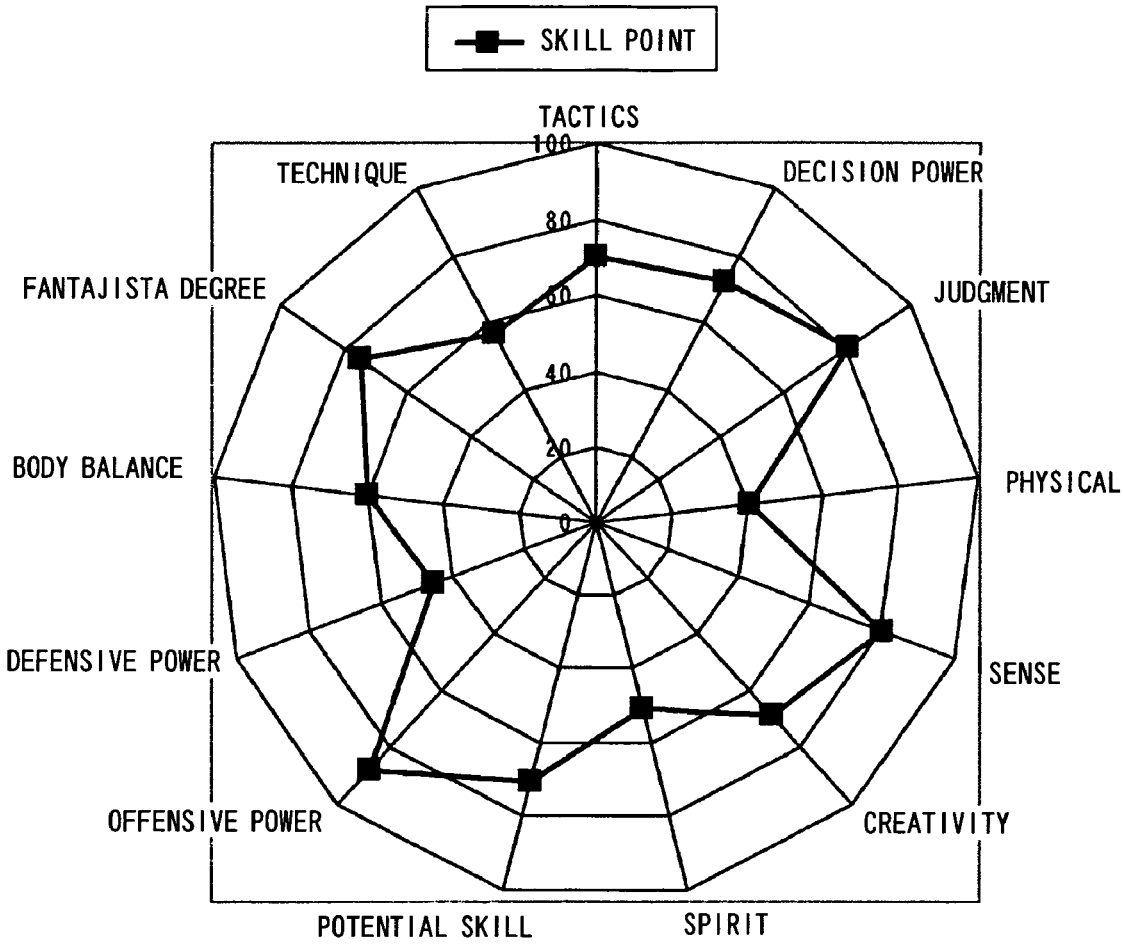
FIG. 15 is a diagram illustrating an example of a skill diagnosis graph.
Figure 16:
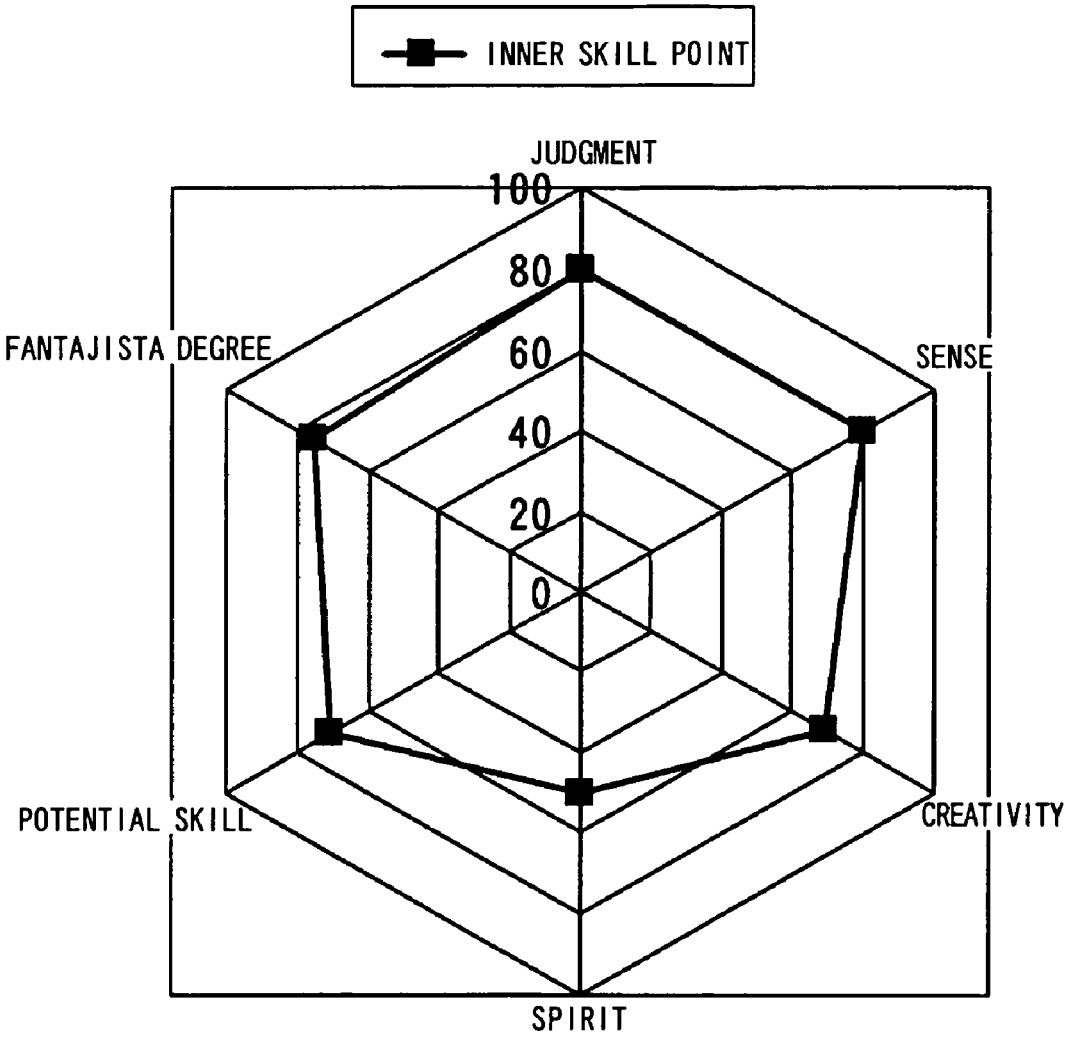
FIG. 16 is a diagram illustrating an example of a skill diagnosis graph which represents inner skills.
Figure 17:
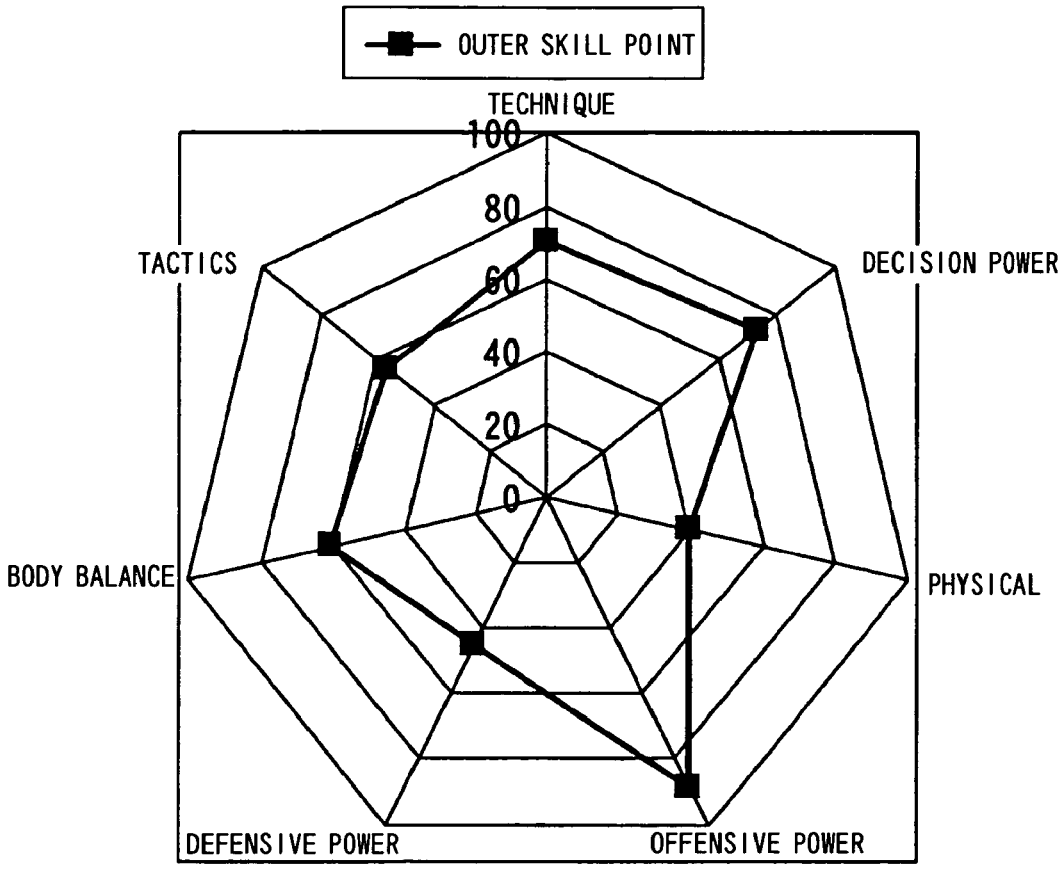
FIG. 17 is a diagram illustrating an example of a skill diagnosis graph which represents outer skills.

Thereafter, irrespective of whether the age of the user is equal to or less than 20 or equal to or more than 21, a skill diagnosis graph wherein the final skill item points settled for the individual skill items are collected is produced at step S38. The skill diagnosis graph may be, for example, such a polygonal graph as shown in FIG. 15 or a graph divided into a graph of FIG. 16 which represents inner skills and another graph of FIG. 17 which represents outer skills.

At next step S39, a final display graph to be displayed finally is determined from the various graphs led out with regard to the user. The number and the form of the graph to be presented are selected in accordance with an application such as the generation, level or the like.

Thereafter, at step S40, the skill item points are collated with the comment table based on the comment pattern designation value selected in such a manner as described above to extract a comment (particular substance of a comment) for each skill item.

Then at step S41, classification of the user in regard to the type is performed based on the type comparison diagnosis graph obtained at step S32 described hereinabove and a comment corresponding to the type is extracted from the comment table.

Then at step S42, it is decided whether or not the basic database includes contest data of the user itself in the past. If such past contest data exist, then the data are compared and diagnosed at step S43. The comparison is performed between the data and the following four data:

(1) contest data of other players in the past;

(2) contest data of other players in the current contest;

(3) personal basic data in the past; and (4) contest data of the user itself in the past.

Then, the four data are collated with the personal basic data in the current contest, future image prediction comparison diagnosis graph, required factor comparison diagnosis graph, skill item-based comparison diagnosis graph, type comparison diagnosis graph and skill diagnosis graph to perform a composite comparison diagnosis regarding the user. Then at step S44, a growth degree diagnosis comment is extracted from the comment table based on the data compared at step S43.

On the other hand, if the basic database does not include contest data of the user itself in the past at step S42, then comparison with the following two data of other players is performed at step S45:

(1) contest data of other players in the past; and (2) contest data of other players in the current contest.

The comparison of the two data is performed with the personal basic data in the current contest, future image prediction comparison diagnosis graph, required factor comparison diagnosis graph, skill item-based comparison diagnosis graph, type comparison diagnosis graph and skill diagnosis graph to perform a composite comparison diagnosis regarding the user. For example, ranking or grouping of the user is performed through the comparison between the skill item points and those of other players calculated at steps S43 and S45, respectively.

At step S46 next to step S44 or S45, a future image prediction comment is extracted from the comment table based on the compared data.

Further at step S47, a comment on the balance of meals is extracted from the comment table based on the arithmetically operated personal basic data.

Then at next step S48, it is decided whether or not the user is a user to whom extraction of a particular comment is to be applied. If the user is a user to whom such extraction is applied, then a health-injury diagnosis comment is extracted from the comment table based on the personal basic data and such comparison diagnosis data as described above regarding the user.

Then at step S50, irrespective of whether or not the user is a user to whom extraction of a particular comment is to be applied, a rearing diagnosis comment is extracted from the comment table making use of such a comment pattern circuit as described hereinabove based on the skill item comments extracted already and decides the extracted rearing diagnosis comment as a final composite comment.

In order to raise the accuracy of such a diagnosis as described above after the fact, the data are stored as new data into the basic database at step S51. Then, required information is displayed on the screen at step S52, and it is decided whether or not it is necessary to print out the data at step S53. If it is necessary to print out the data, then the data are printed out at step S54, whereafter the processing is ended.

The present invention can be applied not only to the sports but also to various games.

While a preferred embodiment of the present invention has been described using specific terms, such description is for illustrative purposes only, and it is to be understood that changes and variations may be made without departing from the spirit or scope of the following claims.

What is claimed is:

1. A sports skill evaluation system, comprising:

an inputting section for inputting, while course selection items displayed on a screen are selected, required data for each of the items regarding a user;

a basic database for storing personal basic data of the user including a level, a match experience, an age and a sex inputted through said inputting section;

a coefficient table in which application coefficients including level-based coefficients, age-based coefficients and sex-based coefficients are stored in advance;

application coefficient calculation means for referring to said coefficient table based on the level, age and sex inputted through said inputting section to determine respective individual application coefficients;

skill item point calculation means for calculating, from a score according to a result of a match of the user inputted through said inputting section and the individual application coefficients determined by said application coefficient calculation section, a skill item point for each of skills required for the match;

skill diagnosis graph production means for producing diagnosis graphs for the individual skills from the skill item points for the individual skills calculated by said skill item point calculation means;

comment pattern designation value calculation means for converting the level, match experience, age and sex inputted through said inputting section into numerical values and calculating comment pattern designation values for the individual skill items based on the numerical values in accordance with a predetermined calculation expression;

a comment table in which a plurality of comments to be presented each as a comment to a user are stored such that the comments are classified for the individual skill items and are numbered for the individual comments; and comment extraction means for extracting a comment of a number corresponding to each of the comment pattern designation values calculated by said comment pattern designation value calculation means for each of the skill items from said comment table.

2. A sports skill evaluation system according to claim 1, further comprising required factor point calculation means for calculating, from the score according to the match result of the user inputted through said inputting section, a point for each of required factors regarding the match, said skill item point calculation means being operable to select, from the points for the individual required factors calculated by said required factor point calculation means, points of required factors relating to the skill items and calculate skill item points from the selected points and the individual application coefficients in accordance with a predetermined calculation expression.

3. A sports skill evaluation system according to claim 2, further comprising required factor-based diagnosis graph production means for producing a diagnosis graph for each of the required factors from the required factor points calculated by said required factor point calculation means.

4. A sports skill evaluation system according to claim 1, further comprising skill item-based comparison diagnosis graph production means for comparing the skill item points calculated by said skill item point calculation means with the other skill item points stored in said basic database to produce a comparison diagnosis graph.

5. A sports skill evaluation system according to claim 1, wherein said comment extraction means extracts a future image prediction comment representative of a predicted future image from said comment table based on a particular age condition inputted through said inputting section.

6. A sports skill evaluation system according to claim 1, wherein said basic database stores heart rates of the user, and said skill item point calculation means calculates a spiritual skill item of the user through comparison between the heart rate in a normal state and the heart rate in a particular situation produced intentionally.

7. A sports skill evaluation system according to claim 1, wherein said basic database stores a health diagnosis result of the user, and said skill item point calculation means refers to the health diagnosis result and basic data arithmetically operated based on the health diagnosis result to calculate points of skill items relating to the health of the user.

8. A sports skill evaluation system according to claim 1, wherein said skill item point calculation means performs ranking of the user based on the calculated skill item points.

9. A sports skill evaluation system according to claim 1, wherein said inputting section inputs basic user data of the user including the level, match experience, age and sex, contest results and so forth from a storage medium.

10. A sports skill evaluation system according to claim 1, wherein said inputting section acquires basic user data of the user including the level, match experience, age and sex through a web site of the Internet, and said comment extraction section presents the extracted comment on the web site.

* * * * *